US005619100A

United States Patent [19]

Kyushima et al.

[11] Patent Number: 5,619,100

[45] **Date of Patent: *Apr. 8, 1997**

[54] PHOTOMULTIPLIER

[75] Inventors: Hiroyuki Kyushima; Koji Nagura; Yutaka Hasegawa; Eiichiro Kawano; Tomihiko Kuroyanagi; Akira Atsumi; Masuya Mizuide, all of Hamamatsu, Japan

[73] Assignee: Hamamatsu Photonics K.K., Shizuoka-ken, Japan

[ * ] Notice: The term of this patent shall not extend beyond the expiration date of Pat. No. 5,510,674.

[21] Appl. No.: 234,158

[22] Filed: Apr. 28, 1994

[30] Foreign Application Priority Data

| | | | |
|---|---|---|---|
| Apr. 28, 1993 | [JP] | Japan | 5-102898 |
| Apr. 28, 1993 | [JP] | Japan | 5-102902 |
| Apr. 28, 1993 | [JP] | Japan | 5-102910 |
| Apr. 30, 1993 | [JP] | Japan | 5-104673 |

[51] Int. Cl.[6] ..... H01J 43/18

[52] U.S. Cl. ..... 313/533; 313/104

[58] Field of Search ..... 313/533, 534, 313/535, 104

[56] References Cited

U.S. PATENT DOCUMENTS

| | | | |
|---|---|---|---|
| 2,574,356 | 11/1951 | Sommer | 445/51 |
| 3,229,143 | 1/1966 | Bartschat | 313/105 R |
| 4,362,692 | 12/1982 | Greenaway | 376/268 |
| 4,395,437 | 7/1983 | Knapp | 427/78 |
| 4,639,638 | 1/1987 | Purcell et al. | 313/534 |
| 4,649,314 | 3/1987 | Eschard | 313/103 CM |
| 4,656,392 | 4/1987 | Faulkner et al. | 313/533 |
| 4,777,403 | 10/1988 | Stephenson | 313/533 |
| 4,825,066 | 4/1989 | Nakamura et al. | 250/207 |
| 4,912,315 | 3/1990 | Arakawa et al. | 250/207 |
| 4,963,113 | 10/1990 | Muramatsu | 445/58 |
| 5,180,943 | 1/1993 | Kyushima | 313/535 |
| 5,254,906 | 10/1993 | Kimura | 313/535 |
| 5,363,014 | 11/1994 | Nakamura | 313/533 |

FOREIGN PATENT DOCUMENTS

| | | | |
|---|---|---|---|
| 0068600 | 1/1983 | European Pat. Off. | H01J 1/88 |
| 2481004 | 10/1981 | France | H01J 43/20 |
| 1539957 | 10/1969 | Germany | H01J 43/10 |
| 3925776 | 3/1990 | Germany | H01J 43/22 |
| 51-43068 | 4/1976 | Japan | H01J 43/22 |
| 3147240 | 6/1991 | Japan | H01J 43/22 |
| 1405256 | 9/1975 | United Kingdom | H01J 31/50 |

OTHER PUBLICATIONS

Eames et al., "Gas Display Spacer Rod Grooves" Jan. 1977 IBM Technical Disclosure Bulletin.

Boulot et al., "Multianode Photomultiplier for Detection and Localization of Low Light level Events", Paper Presented at Nuclear Science Symposium,Washington, Oct. 86, pp. 1–4.

*Primary Examiner*—Alvin E. Oberley
*Assistant Examiner*—Lawrence O. Richardson
*Attorney, Agent, or Firm*—Cushman Darby & Cushman IP Group of Pillsbury Madison & Sutro LLP

[57] ABSTRACT

A photomultiplier is constituted by a photocathode and an electron multiplier having a typical structure in which a dynode unit having a plurality of dynode plates stacked in an incident direction of photoelectrons, an anode plate, and an inverting dynode plate are sequentially stacked. Through holes for injecting a metal vapor are formed in the inverting dynode plate to form secondary electron emitting layers on the surfaces of dynodes supported by the dynode plates, and the photocathode. With this structure, the secondary electron emitting layers are uniformly formed on the surfaces of the dynodes. Therefore, variations in output signals obtained from anodes can be reduced regardless of the positions of the photocathode.

15 Claims, 13 Drawing Sheets

PHOTOMULTIPLIER

BACKGROUND OF THE INVENTION

1. Field of the Invention

The present invention relates to a photomultiplier and, more particularly, to an electron multiplier for constituting the photomultiplier and cascade-multiplying photoelectrons emitted from a photocathode in correspondence with incident light by multilayered dynodes.

2. Related Background Art

Conventionally, photomultipliers have been widely used for various measurements in nuclear medicine and high-energy physics as a γ-camera, PET (Positron Emission Tomography), or calorimeter.

A conventional electron multiplier constitutes a photomultiplier having a photocathode. This electron multiplier is constituted by anodes and a dynode unit having a plurality of stages of dynodes stacked in the incident direction of an electron flow in a vacuum container.

SUMMARY OF THE INVENTION

A photomultiplier according to the present invention comprises an anode, a dynode unit obtained by stacking N stages of dynodes, and inverting dynodes. In the general manufacture of a photomultiplier, when a vacuum container is evacuated, and at the same time, an alkali metal vapor is introduced to deposit and activate a photocathode on the inner surface of a light receiving plate and a secondary electron emitting layer on each dynode, the alkali metal vapor flows from the peripheral portion to the central portion of the light receiving plate or each dynode. Therefore, if no means for passing the metal vapor is provided near the inverting dynodes, the alkali metal layer is deposited to be thin at the central portion and thick at the peripheral portion on the surface of the light receiving plate or each dynode.

FIG. 1 is a graph showing the relationship between positions on the photocathode and the anode output in a photomultiplier having no means for passing the metal vapor near the inverting dynodes, as described above. A position on the circular photocathode is plotted along the abscissa, in which the origin represents the center of the photocathode, and a relative value of the output signal from the anode with respect to the light incident on each position on the photocathode is plotted along the ordinate. As a result, the output signals from the anodes decrease by about 40% at the central portion of the photocathode as compared to the peripheral portion thereof. Therefore, in such a photomultiplier, it is found that the sensitivity of the output signals greatly varies in correspondence with positions on the photocathode at which the light is incident.

It is one of objects of the present invention to provide a photomultiplier capable of obtaining a uniform sensitivity with respect to positions on photocathode.

A photomultiplier according to the present invention is constituted by a photocathode and an electron multiplier including an anode and a dynode unit arranged between the photocathode and the anode.

The electron multiplier is mounted on a base member and arranged in a housing formed integral with the base member for fabricating a vacuum container. The photocathode is arranged inside the housing and deposited on the surface of a light receiving plate provided to the housing. At least one anode is supported by an anode plate and arranged between the dynode unit and the base member. The dynode unit is constituted by stacking a plurality of stages of dynode plates for respectively supporting at least one dynode for receiving and cascade-multiplying photoelectrons emitted from the photocathode in an incidence direction of the photoelectrons.

The housing may have an inner wall thereof deposited a conductive metal for applying a predetermined voltage to the photocathode and rendered conductive by a predetermined conductive metal to equalize the potentials of the housing and the photocathode.

The photomultiplier according to the present invention has at least one focusing electrode between the dynode unit and the photocathode. The focusing electrode is supported by a focusing electrode plate. The focusing electrode plate is fixed on the electron incident side of the dynode unit through insulating members. The focusing electrode plate has holding springs and at least one contact terminal, all of which are integrally formed with this plate. The holding springs are in contact with the inner wall of the housing to hold the arrangement position of the dynode unit fixed on the focusing electrode plate through the insulating members. The contact terminal is in contact with the photocathode to equalize the potentials of the focusing electrodes and the photocathode. The contact terminal functions as a spring.

The focusing electrode plate is engaged with connecting pins, guided into the vacuum container, for applying a predetermined voltage to set a desired potential. For this purpose, an engaging member engaged with the corresponding connecting pin is provided at a predetermined position of a side surface of the focusing electrode plate. The side surface means as a surface in parallel to the incident direction of said photoelectrons in the specification.

A plurality of anodes may be provided to the anode plate, and electron passage holes through which secondary electrons pass are formed in the anode plate in correspondence with positions where the secondary electrons emitted from the last-stage of the dynode unit reach. Therefore, the photomultiplier has, between the anode plate and the base member, an inverting dynode plate for supporting at least one inverting dynode in parallel to the anode plate. The inverting dynode plate inverts the orbits of the secondary electrons passing through the anode plate toward the anodes. The diameter of the electron incident port (dynode unit side) of the electron passage hole formed in the anode plate is smaller than that of the electron exit port (inverting dynode plate side). The inverting dynode plate has, at positions opposing the anodes, a plurality of through holes for injecting a metal vapor to form at least a secondary electron emitting layer on the surface of an each-stage dynode of the dynode unit, and the photocathode.

The through holes formed in the inverting dynode plate to inject a metal vapor may be constituted as follows. That is, the through holes positioned at the center of the inverting dynode plate may have a larger diameter than that of the through holes positioned at the periphery of the inverting dynode plate to improve the injection efficiency of the metal vapor. Of the through holes formed in the inverting dynode plate to inject a metal vapor, the through holes positioned adjacent to each other at the center of the inverting dynode plate may have an interval therebetween smaller than that between the through holes positioned adjacent to each other at the periphery of the inverting dynode plate.

The potential of the inverting dynode plate must be set lower than that of the anode plate to invert the orbits of secondary electrons passing through the through holes of the anode plate. For this purpose, an engaging member engaged with the corresponding connecting pin, guided into the vacuum container, for applying a desired voltage is provided at a predetermined position of the side surface of the inverting dynode plate. A similar engaging member is also provided to a predetermined portion of the anode plate.

On the other hand, the photomultiplier according to the present invention may have, between the inverting dynode plate and the base member, a shield electrode plate for supporting at least one shield electrode in parallel to the inverting dynode plate. The shield electrode plate inverts the orbits of the secondary electrons passing through the anode plate toward the anodes. The shield electrode plate has a plurality of through holes for injecting a metal vapor to form at least a secondary electron emitting layer on the surface of each dynode of the dynode unit. In place of this shield electrode plate, a surface portion of the base member opposing the anode plate may be used as an electrode and substituted for the shield electrode plate.

The potential of the shield electrode plate must also be set lower than that of the anode plate to invert, toward the anode, the orbits of the secondary electrons passing through the through holes of the anode plate. Thus, an engaging member engaged with the corresponding connecting pin, guided into the vacuum container, for applying a desired voltage is also provided at a predetermined position of the side surface of the shield electrode plate.

In particular, the electron multiplier comprises a dynode unit constituted by stacking a plurality of stages of dynode plates, the dynode plates spaced apart from each other at predetermined intervals through insulating members in an incidence direction of the electron flow, for respectively supporting at least one dynode for cascade-multiplying an incident electron flow, and an anode plate opposing the last-stage dynode plate of the dynode unit through insulating members. Each plate described above, such as the dynode plate, has a first depression for arranging a first insulating member which is provided on the first main surface of the dynode plate and partially in contact with the first depression and a second depression for arranging a second insulating member which is provided on the second main surface of the dynode plate and partially in contact with the second depression (the second depression communicates with the first depression through a through hole). The first insulating member arranged on the first depression and the second insulating member arranged on the second depression are in contact with each other in the through hole. An interval between the contact portion between the first depression and the first insulating member and the contact portion between the second depression and the second insulating member is smaller than that between the first and second main surfaces of the dynode plate. The first and second depressions discussed above can be provided in the anode plate, the focusing plate, inverting dynode plate and the shield electrode plate.

Important points to be noted in the above structure will be listed below. The first point is that gaps are formed between the surface of the first insulating member and the main surface of the first depression and between the second insulating member and the main surface of the second depression, respectively, to prevent discharge between the dynode plates. The second point is that the central point of the first insulating member, the central point of the second insulating member, and the contact point between the first and second insulating members are aligned on the same line in the stacking direction of the dynode plates so that the intervals between the dynode plates can be sufficiently kept.

Using spherical or circularly cylindrical bodies as the first and second insulating members, the photomultiplier can be easily manufactured. When circularly cylindrical bodies are used, the outer surfaces of these bodies are brought into contact with each other. The shape of an insulating member is not limited to this. For example, an insulating member having an elliptical or polygonal section can also be used as long as the object of the present invention can be achieved.

In this electron multiplier, each plate described above, such as the dynode plate, has an engaging member at a predetermined position of a side surface of the plate to engage with a corresponding connecting pin for applying a predetermined voltage. Therefore, the engaging member is projecting in a vertical direction to the incident direction of the photoelectrons. The engaging member is constituted by a pair of guide pieces for guiding the connecting pin. On the other hand, a portion near the end portion of the connecting pin, which is brought into contact with the engaging member, may De formed of a metal material having a rigidity lower than that of the remaining portion.

Each dynode plate is constituted by at least two plates, each having at least one opening for forming as the dynode and integrally formed by welding such that the openings are matched with each other to function as the dynode when the two plates are overlapped. To integrally form these two plates by welding, each of the plates has at least one projecting piece for welding the corresponding two plates. The side surface of the plate is located in parallel with respect to the incident direction of the photoelectrons.

The photomultiplier according to the present invention has a structure in which the focusing electrode plate, the dynode plates constituting the dynode unit, the anode plate, the inverting dynode plate, and the shield electrode plate are sequentially stacked through insulating members in an incident direction of photoelectrons emitted from the photocathode. Therefore, the depression can be formed in the main surface of each plate to obtain a high structural strength and prevent discharge between the plates.

The photomultiplier according to the present invention has the inverting dynode plate for supporting at least one inverting dynode arranged under the anode plate in parallel to each dynode plate. A plurality of through holes are arranged in this inverting dynode plate. For this reason, when an alkali metal vapor is introduced into the vacuum container to deposit and activate the photocathode on the light receiving plate and the secondary electron emitting layers on the each-stage dynode of the dynode unit, the alkali metal vapor is introduced from the bottom portion of the vacuum container. The alkali metal vapor then sequentially passes through the through holes of the inverting dynode plate, the electron passage holes of the anode plate, the electron multiplication holes (portions serving as dynodes) of each dynode plate, and the through holes of the focusing electrode plate, and is uniformly deposited from the central portions to the peripheral portions of the surfaces of each dynode and the light receiving plate. Therefore, generation of the photoelectrons or emission of the secondary electrons is performed at each position on the photocathode or the dynodes with uniform reactivity, thereby reducing variations in sensitivity of the output signals corresponding to the photocathode positions on which the light is incident.

The shield electrode plate arranged under the inverting dynode plate in parallel to each dynode plate and the anode plate inverts the photoelectrons incident on the through holes of the inverting dynode plate toward the anodes. For this reason, the photoelectrons passing through the electron passage holes of the anodes hardly pass through the inverting dynode plate and are captured by the anodes at a high efficiency. In addition, since a plurality of through holes are arranged in this shield electrode plate, the alkali metal vapor introduced from the bottom portion of the vacuum container is uniformly distributed to the surface of each dynode plate or the light receiving plate. Further, variations in sensitivity of the output signals corresponding to the photocathode positions on which the light is incident are reduced.

The through holes of the inverting dynode plate are arranged at a pitch almost equal to that of the electron multiplication holes of each dynode plate. In other words, the through holes are formed at positions opposing the positions where the anodes of the anode plate are formed. For this reason, the alkali metal vapor is efficiently and uniformly distributed to the surface of each dynode or the light receiving plate. At the same time, the electrons passing through the electron passage holes of the anode plate hardly pass through the through holes of the inverting dynode plate. In addition, variations in sensitivity of the output signals corresponding to positions on the photocathode on which the light is incident are reduced.

When the arrangement pitch between the through holes of the inverting dynode plate or their diameter is changed at the peripheral and central portions of the plate, the alkali metal vapor introduced from the bottom portion of the vacuum container is uniformly distributed to the surface of each dynode or the light receiving plate. Therefore, the output signals corresponding to the photocathode positions on which the light is incident have a more uniform sensitivity.

The contact portion between the insulating member and the depression is positioned in the direction of thickness of the dynode plate rather than the main surface of the dynode plate having the depression. Therefore, the intervals between the dynode plates can be substantially increased (FIGS. 12 and 13).

Discharge between the dynode plates is often caused due to dust or the like deposited on the surface of the insulating member. However, in the structure according to the present invention, intervals between the dynode plates are substantially increased, thereby obtaining a structure effective to prevent the discharge.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

An embodiment of the present invention will be described below with reference to FIGS. 2 to 23.

Figure 2:
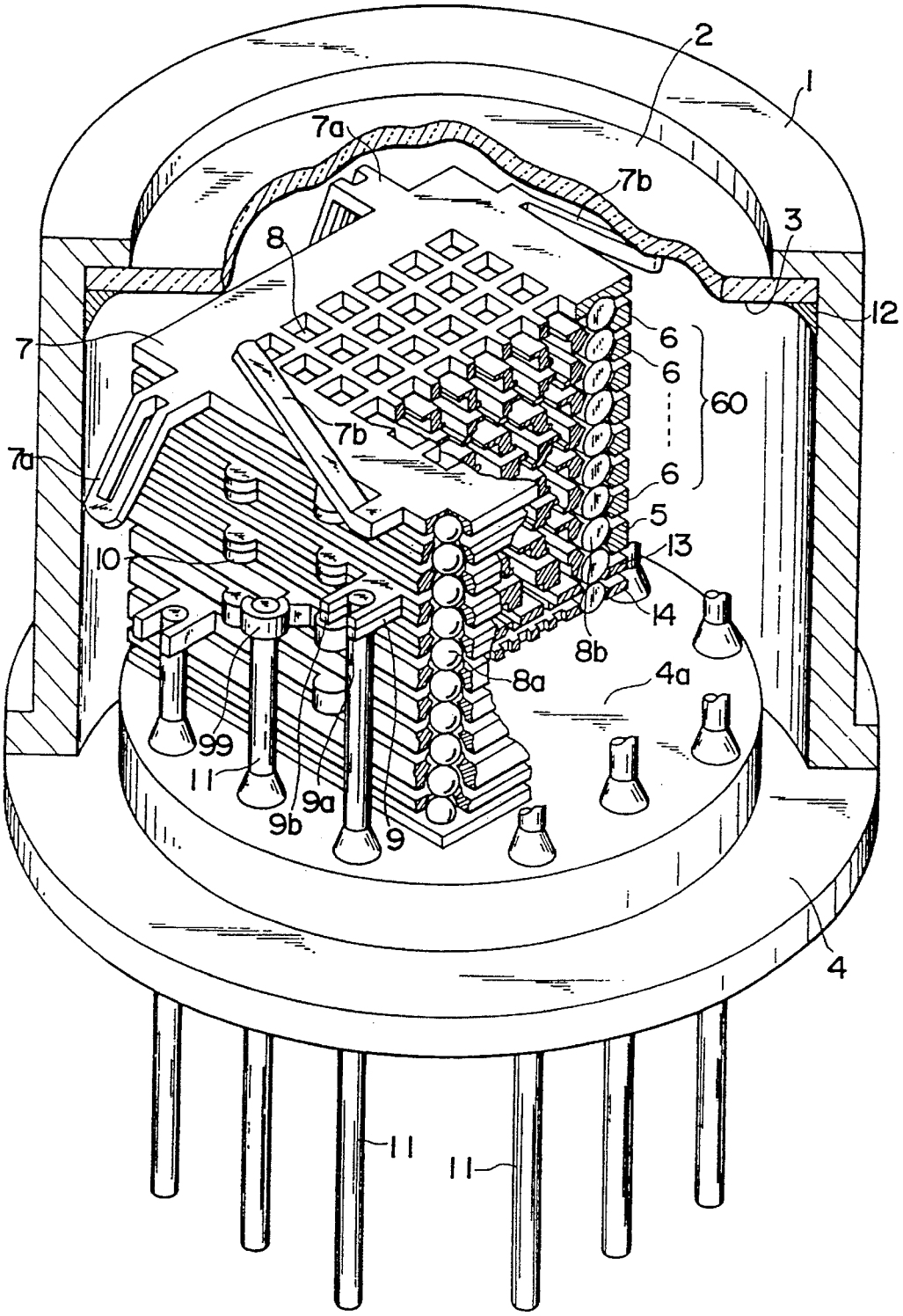
FIG. 2 is partially cutaway perspective view showing the entire structure of a photomultiplier according to the present invention.

FIG. 2 is a perspective view showing the entire structure of a photomultiplier according to the present invention. Referring to FIG. 2, the photomultiplier is basically constituted by a photocathode 3 and an electron multiplier. The electron multiplier includes anodes (anode plate 5) and a dynode unit 60 arranged between the photocathode 3 and the anodes.

The electron multiplier is mounted on a base member 4 and arranged in a housing 1 which is formed integral with the base member 4 to fabricate a vacuum container. The photocathode 3 is arranged inside the housing 1 and deposited on the surface of a light receiving plate 2 provided to the housing 1. The anodes are supported by the anode plate 5 and arranged between the dynode unit 60 and the base member 4. The dynode unit 60 is constituted by stacking a plurality of stages of dynode plates 6, for respectively supporting a plurality of dynodes 603 (see FIG. 5) for receiving and cascade-multiplying photoelectrons emitted from the photocathode 3, in the incidence direction of the photoelectrons.

The photomultiplier also has focusing electrodes 8 between the dynode unit 60 and the photocathode 3 for correcting orbits of the photoelectrons emitted from the photocathode 3. These focusing electrodes 8 are supported by a focusing electrode plate 7. The focusing electrode plate 7 is fixed on the electron incidence side of the dynode unit 60 through insulating members **8*a* and 8*b*. The focusing electrode plate 7 has holding springs 7*a* and contact terminals 7*b*, all of which are integrally formed with this plate 7. The holding springs 7*a* are in contact with the inner wall of the housing 1 to hold the arrangement position of the dynode unit 60 fixed on the focusing electrode plate 7 through the insulating members 8*a* and 8*b*. The contact terminals 7*b* are in contact with the photocathode 3 to equalize the potentials of the focusing electrodes 8 and the photocathode 3 and functions as springs. When the focusing electrode plate 7 has no contact terminal 7*b*, the housing 1 may have an inner wall thereof deposited a conductive metal for applying a desired voltage to the photocathode 3, and the contact portion between the housing 1 and the photocathode 3 may be rendered conductive by a predetermined conductive metal 12 to equalize the potentials of the housing 1 and the photocathode 3. Although both the contact terminals 7*b* and the conductive metal 12 are illustrated in FIG. 2**, one structure can be selected and realized in an actual implementation.

This focusing electrode plate 7 is engaged with a connecting pin 11, guided into the vacuum container, for applying a desired voltage to set a desired potential. For this purpose, an engaging member 9 (or 99) engaged with the corresponding connecting pin 11 is provided at a predetermined position of a side surface of the focusing electrode plate 7. The engaging member 9 may be constituted by a pair of guide pieces **9*a* and 9*b* for guiding the corresponding connecting pin 11**.

The anode is supported by the anode plate 5. A plurality of anodes may be provided to this anode plate 5, and electron passage holes through which secondary electrons pass are formed in the anode plate 5 in correspondence with positions where the secondary electrons emitted from the last-stage dynode of the dynode unit 60 reach. Therefore, this photomultiplier has, between the anode plate 5 and the base member 4, an inverting dynode plate 13 for supporting inverting dynodes in parallel to the anode plate 5. The inverting dynode plate 13 inverts the orbits of the secondary electrons passing through the anode plate 5 toward the anodes. The diameter of the electron incident port (dynode unit 60 side) of the electron passage hole formed in the anode plate 5 is smaller than that of the electron exit port (inverting dynode plate 13 side). The inverting dynode plate 13 has, at positions opposing the anodes, a plurality of through holes for injecting a metal vapor to form a secondary electron emitting layer on the surface of each dynode 603 of the dynode unit 60.

Figure 3:
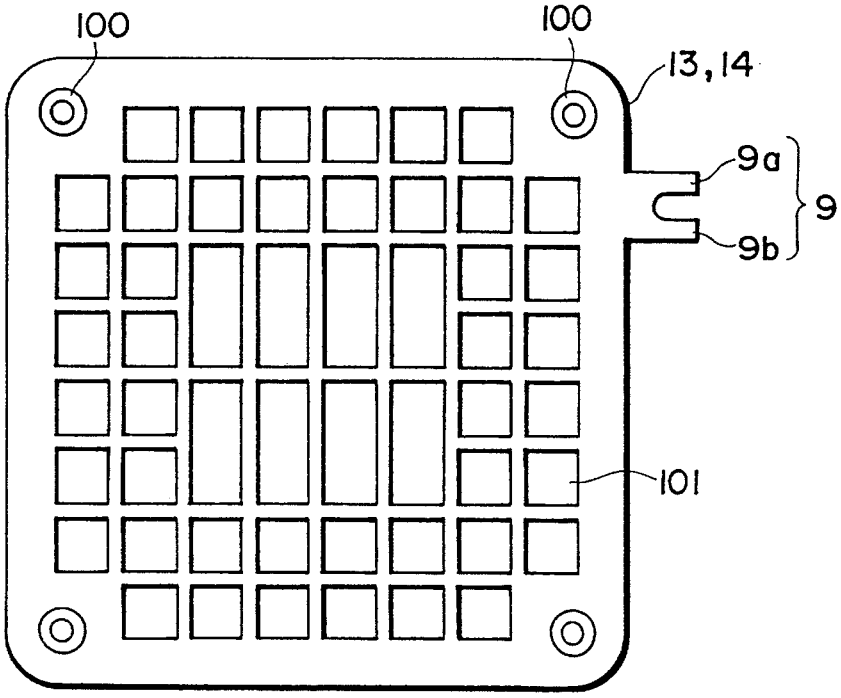
FIG. 3 is a plan view showing the first structure of an inverting dynode plate or shield electrode plate.
Figure 4:
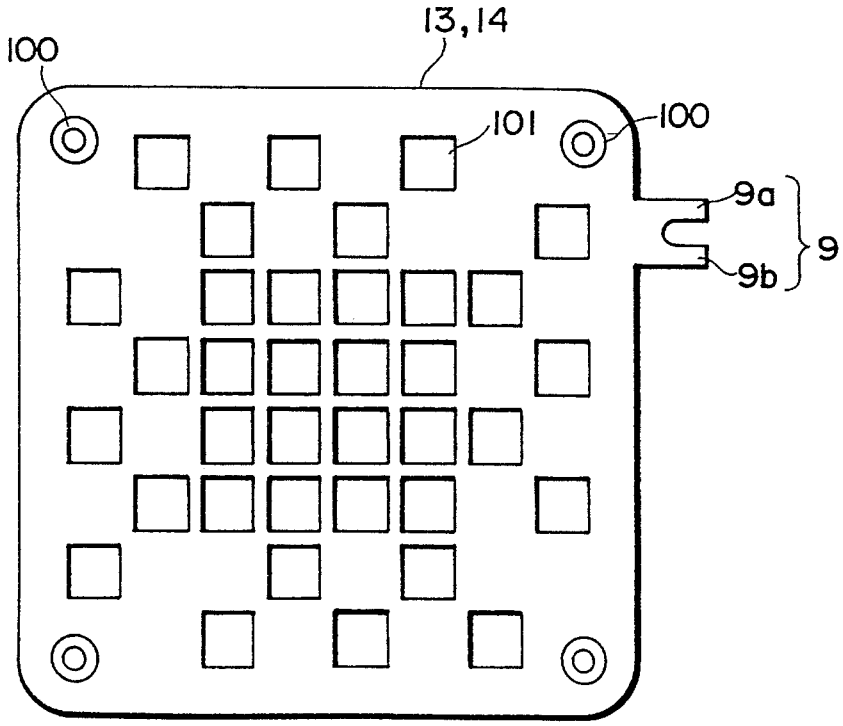
FIG. 4 is a plan view showing the second structure of the inverting dynode plate or shield electrode plate.

Through holes 101 formed in the inverting dynode plate 13 to inject a metal vapor may be constituted as shown in FIG. 3 or 4. That is, the through holes positioned at the center of the plate 13 may have a larger area than that of the through holes positioned at the periphery of the plate 13 to improve the injection efficiency of the metal vapor (see FIG. 3). In addition, of the through holes formed in the inverting dynode plate 13 to inject the metal vapor, the through holes positioned adjacent to each other at the center of the plate 13 may have an interval therebetween smaller than that between the through holes positioned adjacent to each other at the periphery of the plate 13 (see FIG. 4). Referring to FIGS. 3 and 4, reference numeral 100 denotes a depression for arranging an insulating member partially in contact with the inverting dynode plate 13 to provide a predetermined interval between an anode plate 5 and the inverting dynode plate 13.

The potential of the inverting dynode plate 13 must also be set lower than that of the anode plate 5 to invert, toward the anodes, the orbits of the secondary electrons passing through holes 501 (see FIG. 15) of the anode plate 5. Thus, the engaging member 9 (or 99) engaged with the corresponding connecting pin, guided into the vacuum container, for applying a predetermined voltage is provided at a predetermined position of the side surface of the inverting dynode plate 13. The similar engaging member 9 is also provided at a predetermined portion of the anode plate 5.

On the other hand, the photomultiplier may have, between the inverting dynode plate 13 and the base member 4, a shield electrode plate 14 for supporting shield electrodes in parallel to the inverting dynode plate 13. The shield electrode plate 14 inverts the orbits of the secondary electrons passing through the anode plate 5 toward the anodes. The shield electrode plate 14 has a plurality of through holes for injecting a metal vapor to form a secondary electron emitting layer on the surface of each dynode 603 (see FIGS. 16 and 17) of the dynode unit 60. In place of this shield electrode plate 14, a surface portion **4*a* of the base member 4 opposing the anode plate 5 may be used as a sealed electrode and substituted for the shield electrode plate 14**.

As in the inverting dynode plate 13, the potential of the shield electrode plate 14 must also be set lower than that of the anode plate 5 to invert, toward the anodes, the orbits of the secondary electrons passing through the through holes 501 of the anode plate 5. Thus, the engaging member 9 engaged with the corresponding connecting pin 11, guided into the vacuum container, for applying a desired voltage is also provided at a predetermined position of the side surface of the shield electrode plate 14. The shield electrode plate 14 may have the same structure as that of the inverting dynode plate 13 shown in FIGS. 3 and 4.

In particular, the electron multiplier comprises a dynode unit 60 constituted by stacking a plurality of stages of dynode plates 6, spaced apart from each other at predetermined intervals by the insulating members 8*a* and 8*b* in the incidence direction of the electron flow, and each dynode plate 6 is supporting a plurality of dynodes 603 for cascade-multiplying an incident electron flow, and the anode plate 5 opposing the last-stage dynode plate 6 of the dynode unit 60 through the insulating members 8*a* and 8*b*.

In this electron multiplier, each dynode plate 6 has an engaging member 9 at a predetermined position of a side surface of the plate to engage with a corresponding connecting pin 11 for applying a desired voltage. The side surface of the dynode plate 6 is in parallel with respect to the incident direction of the photoelectrons. The engaging member 9 is constituted by a pair of guide pieces 9*a* and 9*b* for guiding the connecting pin 11. The engaging member may have a hook-like structure (engaging member 99 illustrated in FIG. 2). The shape of this engaging member is not particularly limited as long as the connecting pin 11 is received and engaged with the engaging member. On the other hand, a portion near the end portion of the connecting pin 11, which is brought into contact with the engaging member 9, may be formed of a metal material having a rigidity lower than that of the remaining portion.

Each dynode plate 6 is constituted by two plates 6*a* and 6*b* having openings for forming the dynodes and integrally formed by welding such that the openings are matched with each other to function as dynodes when the two plates overlap each other. To integrally form the two plates 6*a* and 6*b* by welding, the two plates 6*a* and 6*b* have projecting pieces 10 for welding the corresponding projecting pieces thereof at predetermined positions matching when the two plates 6*a* and 6*b* overlap each other.

Figure 5:
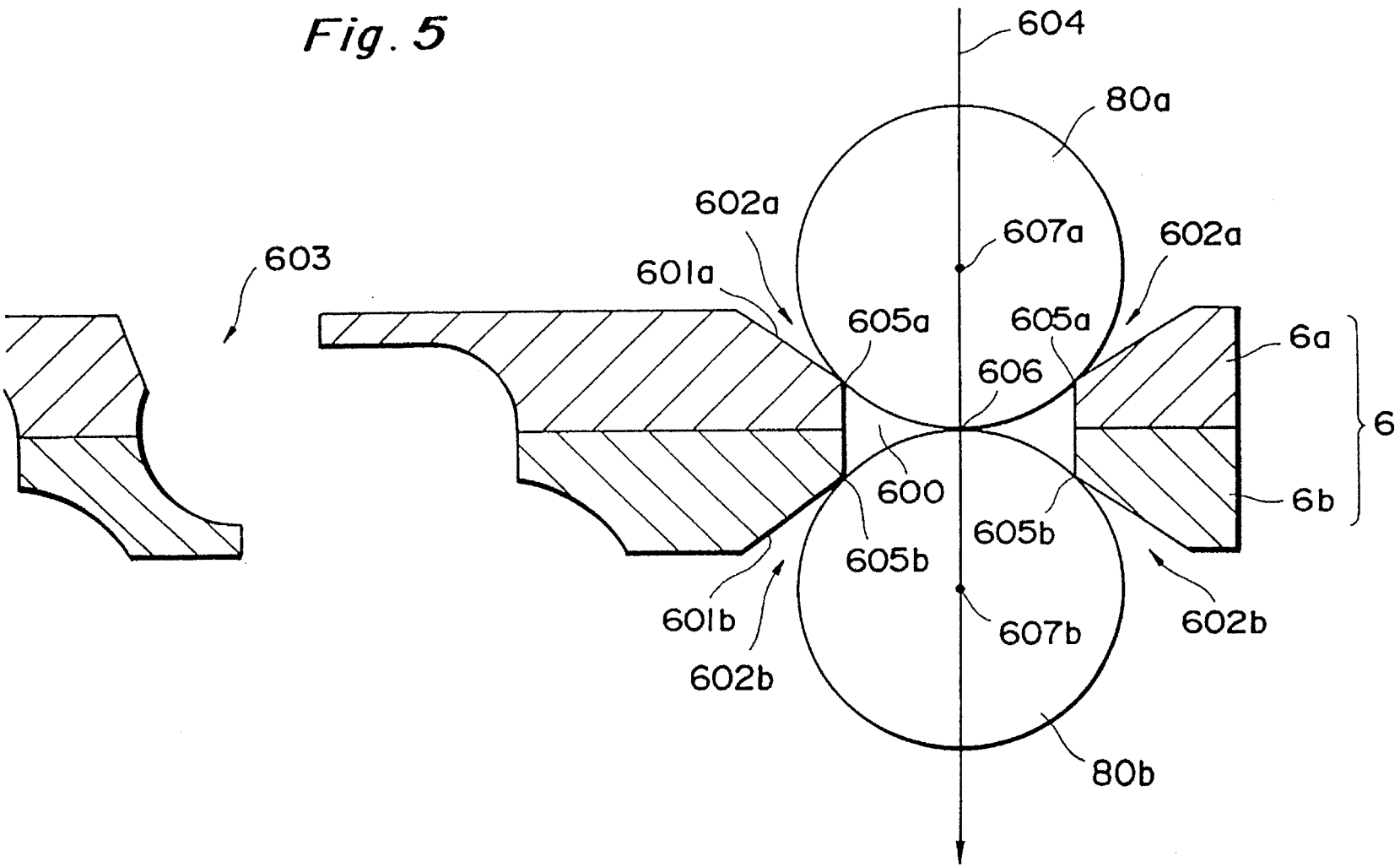
FIG. 5 is a sectional view for explaining the structure of depressions formed in a focusing electrode plate, a dynode plate, an anode plate, the inverting dynode plate, and the shield electrode plate.

The structure of each dynode plate 6 for constituting the dynode unit 60 will be described below. FIG. 5 is a sectional view showing the shape of each plate, such as the dynode plate 6. Referring to FIG. 5, the dynode plate 6 has a first depression 601*a* for arranging a first insulating member 80*a* which is provided on a first main surface of the dynode plate 6 and partially in contact with the first depression 601*a* and a second depression 601*b* for arranging a second insulating member 80*b* which is provided on a second main surface of the dynode plate 6 and partially in contact with the second depression 601*b* (the second depression 601*b* communicates with the first depression 601*l* through a through hole 600). The first insulating member 80*a* arranged on the first depression 601*a* and the second insulating member 80*b* arranged on the second depression 601*b* are in contact with each other in the through hole 600. An interval between the contact portion 605*a* between the first depression 601*a* and the first insulating member 80*a* and the contact portion 605*b* of the second depression 601*b* and the second insulating member 80*b* is smaller than that (thickness of the dynode plate 6) between the first and second main surfaces of the dynode plate 6.

Gaps 602*a* and 602*b* are formed between the surface of the first insulating member 80*a* and the main surface of the first depression 601*a* and between the second insulating member 80*b* and the main surface of the second depression 601*b*, respectively, to prevent discharge between the dynode plates 6. A central point 607*a* of the first insulating member 80*a*, a central point 607*b* of the second insulating member 80*b*, and a contact point 606 between the first and second insulating members 80*a* and 80*b* are aligned on the same line 604 in the stacking direction of the dynode plates 6 so that the intervals between the dynode plates 6 can be sufficiently kept.

Figure 21:
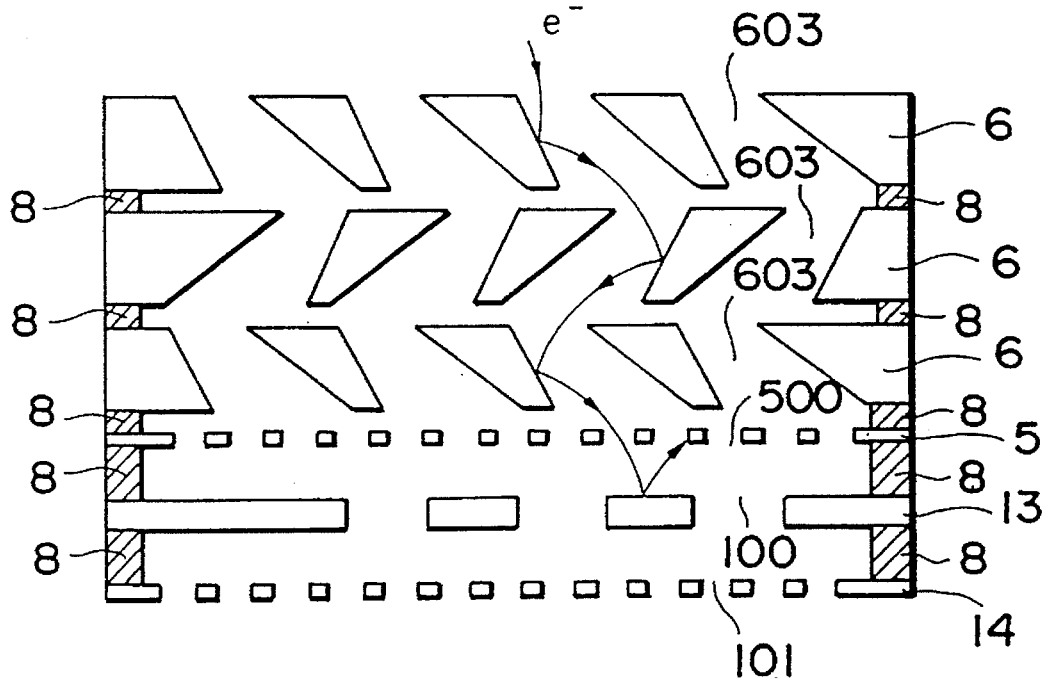
FIG. 21 is a sectional view showing the main part of the structure of the fourth application of the electron multiplier in the photomultiplier shown in FIG. 16.

The photomultiplier according to the present invention has a structure in which the focusing electrode plate 7, dynode plates 6 for constituting a dynode unit 60, the anode plate 5, the inverting dynode plate 13, and the shield electrode plate 14 are sequentially stacked through insulating members 8 (insulating members 8*a* and 8*b* shown in FIG. 2 are included: FIG. 21) in the incident direction of the photoelectrons emitted from the photocathode 3. Therefore, the above-described depressions can be formed in the main surfaces of the plates 5, 6, 7, 13, and 14 to obtain a high structural strength and prevent discharge between the plates.

Figure 6:
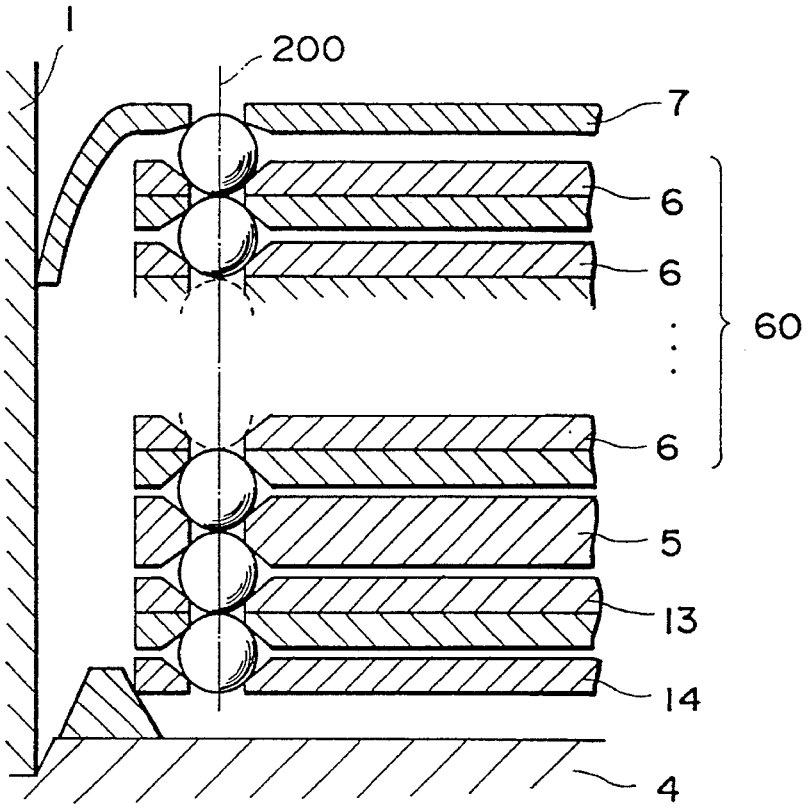
FIG. 6 is a sectional view showing the first application for explaining the arrangement condition of the focusing electrode plate, the dynode plate, the anode plate, the inverting dynode plate, and the shield electrode plate shown in FIG. 2.

FIG. 6 is a sectional view showing a state in which the electron multiplier constituted by stacking the plates is fixed in the vacuum container constituted by a housing 1 and a base member 4. As shown in FIG. 6, an insulating member sandwiched between the focusing electrode plate 7 and the first-stage dynode plate 6, insulating members sandwiched between the dynode plates 6, an insulating member sandwiched between the last-stage dynode plate 6 and the anode plate 5, an insulating member sandwiched between the anode plate 5 and the inverting dynode plate 13, and an insulating member sandwiched between the inverting dynode plate 13 and the shield electrode plate 14 are in direct contact with the adjacent insulating members. When the central points of these insulating members are aligned on the same line 200, the mechanical strength in the stacking direction of the electron multiplier can be increased. With this structure, damage to the plate itself can be prevented, and at the same time, the intervals between the plates can be sufficiently kept.

Figure 7:
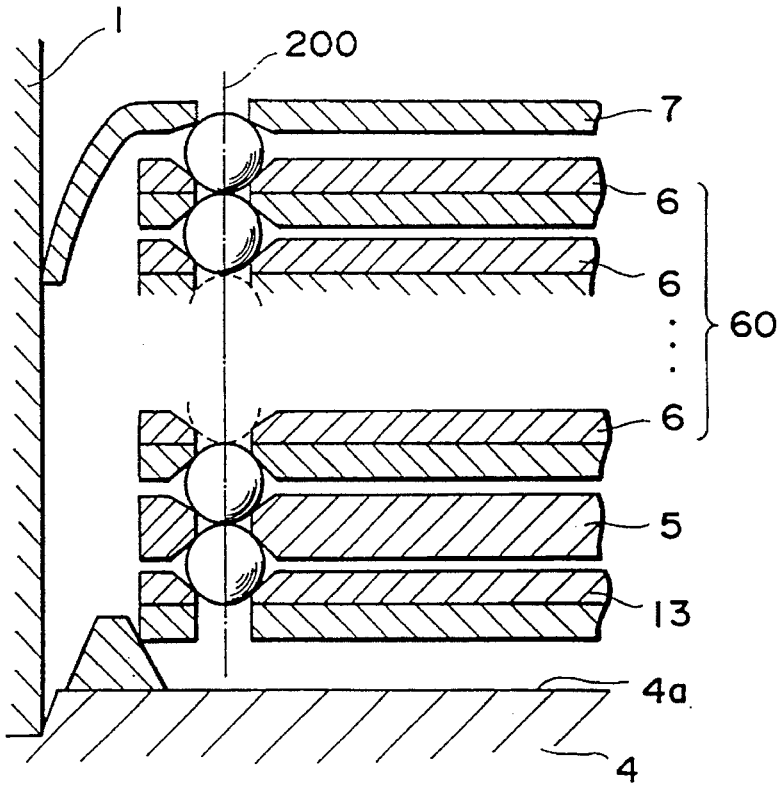
FIG. 7 is a sectional view showing the second application for explaining the arrangement condition of the focusing electrode plate, the dynode plate, the anode plate, the inverting dynode plate, and the shield electrode plate shown in FIG. 2.

On the other hand, a region 4*a* of the base member 4, which opposes the inverting dynode plate 13, can be substituted for the shield electrode plate 14. In this case, the electron multiplier can be constituted as shown in FIG. 7.

Using the spherical bodies 8*a* or circularly cylindrical bodies 8*b* are used as the first and second insulating members 80*a* and 80*b* (insulating members 8*a* and 8*b* in FIG. 2), the photomultiplier can be easily manufactured. When circularly cylindrical bodies are used, the side surfaces of the circularly cylindrical bodies are brought into contact with each other. The shape of the insulating member is not limited to this. For example, an insulating member having an elliptical or polygonal section can also be used as long as the object of the present invention can be achieved. Referring to FIG. 3, reference numeral 603 denotes a dynode. A secondary electron emitting layer containing an alkali metal is formed on the surface of this dynode.

The shapes of the depression formed on the main surface of the plate 5, 6, 7, 13, or 14 will be described below with reference to FIGS. 8 to 11. For the sake of descriptive convenience, only the first main surface of the dynode plate 6 is disclosed in FIGS. 8 to 11. In these plates, the depression may be formed only in one main surface if there is no structural necessity.

Figure 8:
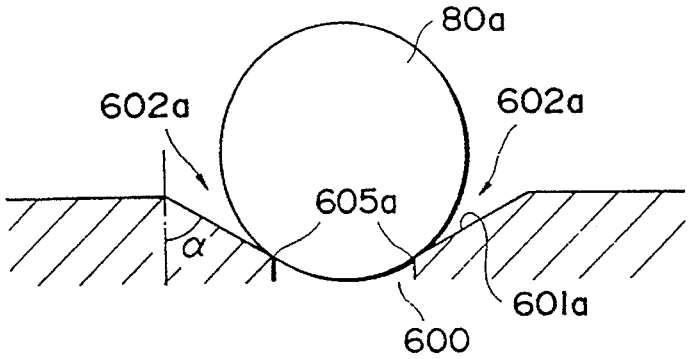
FIG. 8 is a sectional view showing the structure of the depression shown in FIG. 5 as the first application.

The first depression 601*a* is generally constituted by a surface having a predetermined taper angle ($\alpha$) with respect to the direction of thickness of the dynode plate 6, as shown in FIG. 8.

Figure 9:
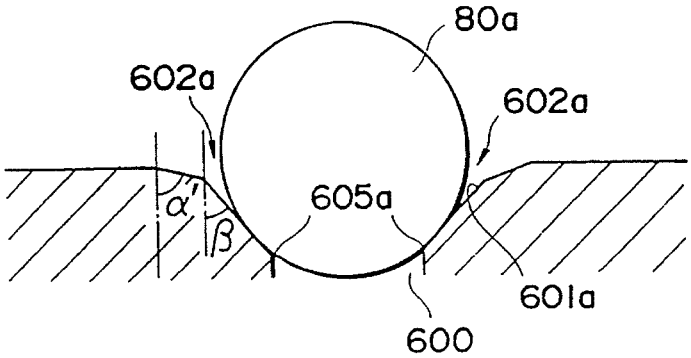
FIG. 9 is a sectional view showing the structure of the depression shown in FIG. 5 as the second application

This first depression 601*a* may be constituted by a plurality of surfaces having predetermined taper angles ($\alpha$ and $\beta$) with respect to the direction of thickness of the dynode plate 6, as shown in FIG. 9.

Figure 10:
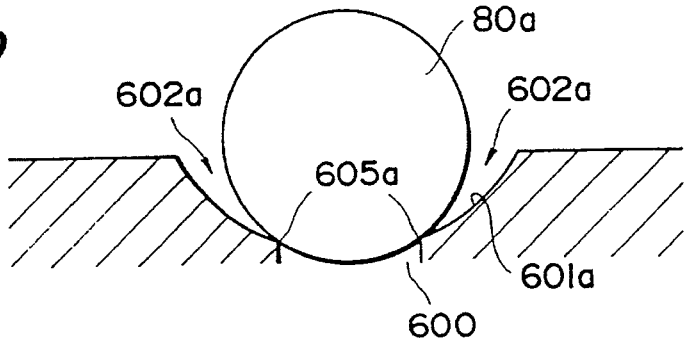
FIG. 10 is a sectional view showing the structure of the depression shown in FIG. 5 as the third application.

The surface of the first depression 601*a* may be a curved surface having a predetermined curvature, as shown in FIG. 10. The curvature of the surface of the first depression 601*a* is set smaller than that of the first insulating member 80*a*, thereby forming the gap 602*a* between the surface of the first depression 601*a* and the surface of the first insulating member 80*a*.

Figure 11:
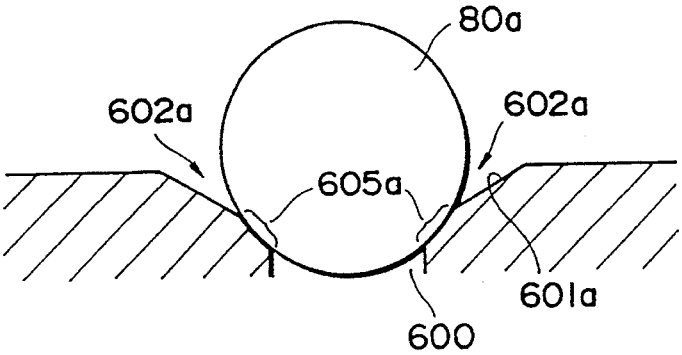
FIG. 11 is a sectional view showing the structure of the depression shown in FIG. 5 as the fourth application.

To obtain a stable contact state with respect to the first insulating member 80*a*, a surface to be brought into contact with the first insulating member 80*a* may be provided to the first depression 601*a*, as shown in FIG. 11. In this embodiment, a structure having a high mechanical strength against a pressure in the direction of thickness of the dynode plate 6 even compared to the above-described structures in FIGS. 8 to 10 can be obtained.

Figure 12:
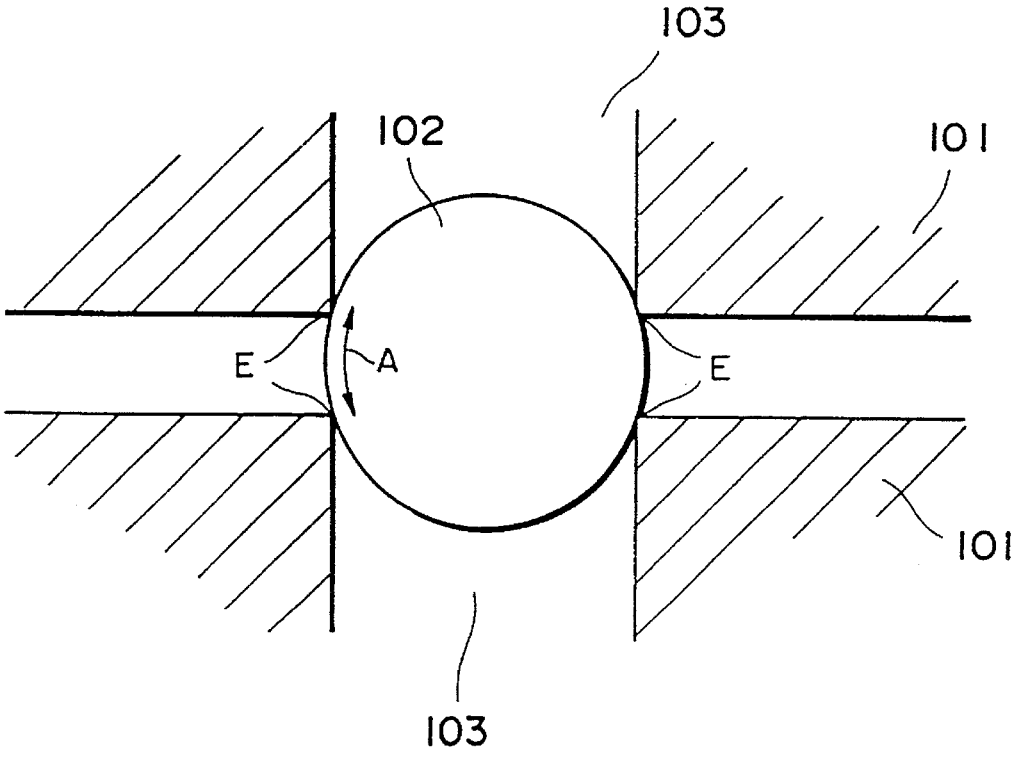
Fig. 12 (PRIOR ART)
FIG. 12 is a sectional view showing the structure of a comparative example for explaining the effect of the present invention.
Figure 13:
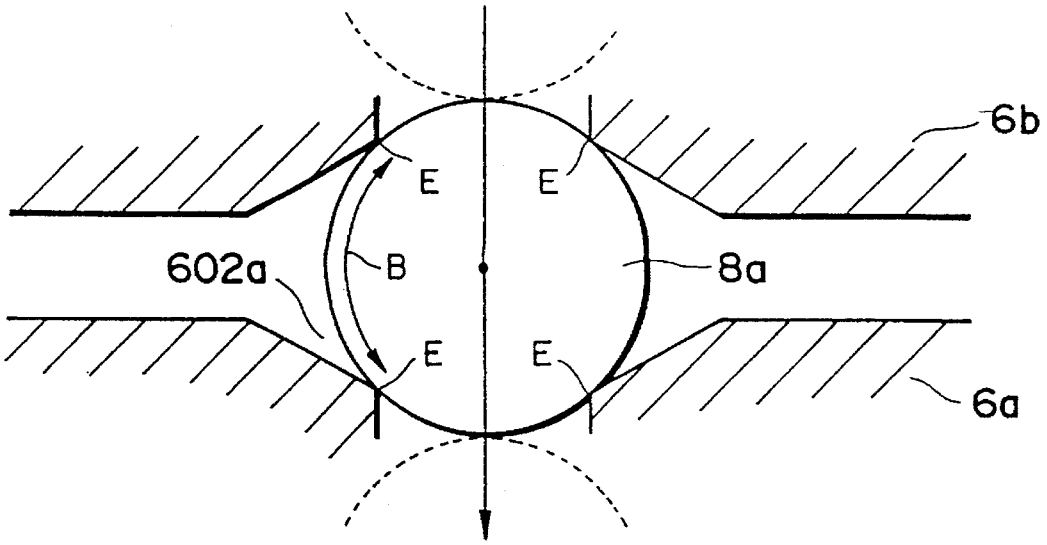
FIG. 13 is a sectional view showing the structure between the dynode plates adjacent to each other, for explaining the effect of the present invention.

The detailed structure between the dynode plates 6, adjacent to each other, of the dynode unit 60 will be described below with reference to FIGS. 12 and 13. FIG. 12 is a partial sectional view showing the conventional photomultiplier as a comparative example of the present invention. FIG. 13 is a partial sectional view showing the photomultiplier according to an embodiment of the present invention.

In the comparative example shown in FIG. 12, the interval between the support plates 101 having no depression is almost the same as a distance A (between contact portions E between the support plates 101 and the insulating member 102) along the surface of the insulating member 102.

On the other hand, in an embodiment of the present invention shown in FIG. 13, since depressions are formed, a distance B (between the contact portions E between the plates 6*a* and 6*b* and the insulating member 8*a*) along the surface of the insulating member 8*a* is larger than the interval between plates 6*a* and 6*b*. Generally, discharge between the plates 6*a* and 6*b* is assumed to be caused along the surface of the insulating member 8*a* due to dust or the like deposited on the surface of the insulating member 8*a*. Therefore, as shown in this embodiment (see FIG. 13), when the depressions are formed, the distance B along the surface of the insulating member 8*a* substantially increases as compared to the interval between the plates 6*a* and 6*b*, thereby preventing discharge which occurs when the insulating member 8*a* is inserted between the plates 6*a* and 6*b*.

The detailed structure of the photomultiplier will be described with reference to FIGS. 14 to 23.

Figure 14:
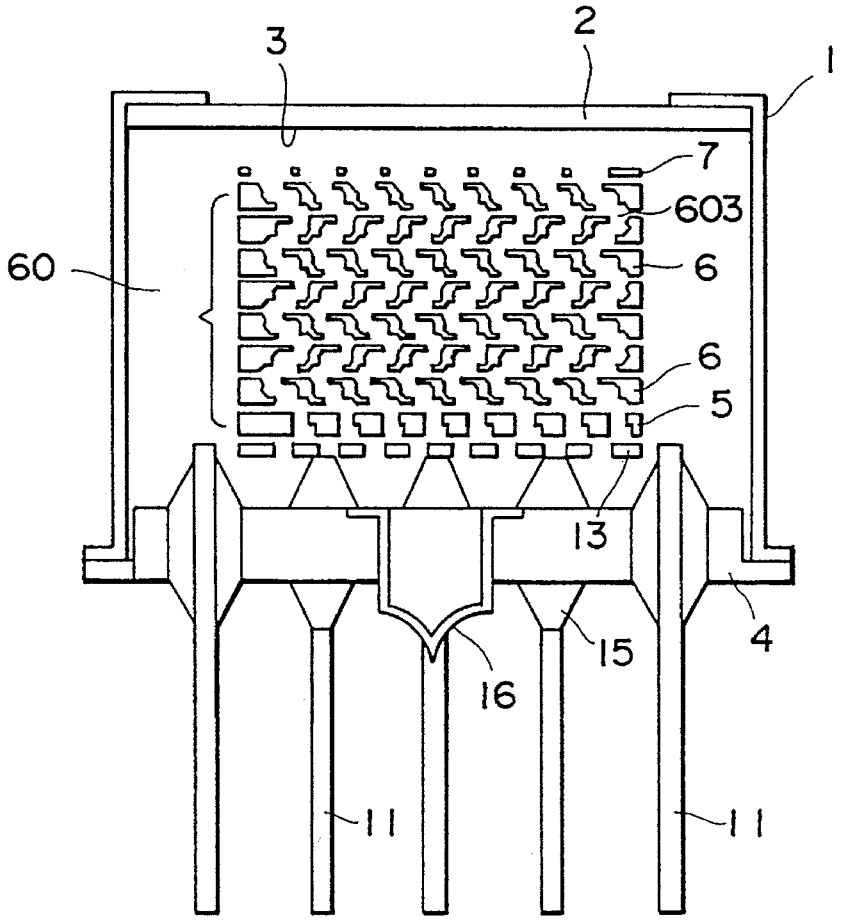
FIG. 14 is a sectional view showing the structure of the first application of the photomultiplier according to the present invention.

FIG. 14 is a sectional view showing the structure of a photomultiplier according to the first embodiment of the present invention. In this photomultiplier, a vacuum container 1 is constituted by a light receiving plate 2 for receiving incident light, a cylindrical metal housing 1 disposed along the circumference of the light receiving plate 2, and a circular metal base 4 for constituting a base member, and a dynode unit 60 for multiplying an incident electron flow is disposed in the vacuum container.

Connecting pins 11 connected to external voltage terminals to apply a desired voltage to the dynode unit 60 or the like extend through the metal base 4. Each connecting pin 11 is fixed to the metal base 4 outside the vacuum container by hermetic glass 15 having a shape tapered from the surface of the metal base 4 along the connecting pin 11. A metal tip tube 16 having the end portion compression-bonded and sealed projects downward from the center of the metal base 4. This metal tip tube 16 serves as a through hole used to introduce an alkali metal vapor into the vacuum container or evacuate the vacuum container. When the photomultiplier is completed, the metal tip tube 16 is sealed, as shown in FIG. 14. Taking the breakdown voltage or leakage current into consideration, the hermetic glass 15 has a shape tapered along the connecting pin 11.

On the inner lower surface of the light receiving plate 2, after MnO or Cr is vacuum-deposited, Sb is deposited, and an alkali metal such as K or Cs is then formed and activated to form a bialkali photocathode 3. The photocathode 3 is set at a predetermined potential, and for example, the potential is held at 0 V.

A focusing electrode plate 7 for supporting focusing electrodes 8 formed of a stainless plate is disposed between the photocathode 3 and the dynode unit 60. A plurality of through holes are formed in this focusing electrode 7 and arranged in a matrix form at a predetermined pitch. Each focusing electrode 8 is set at a desired potential, and for example, the potential is held at 0 V. Therefore, the photoelectrons emitted from the photocathode 3 are focused by the focusing electrodes 8 and incident on a predetermined region (first-stage dynode plate 6) of the dynode unit 60.

Figure 15:
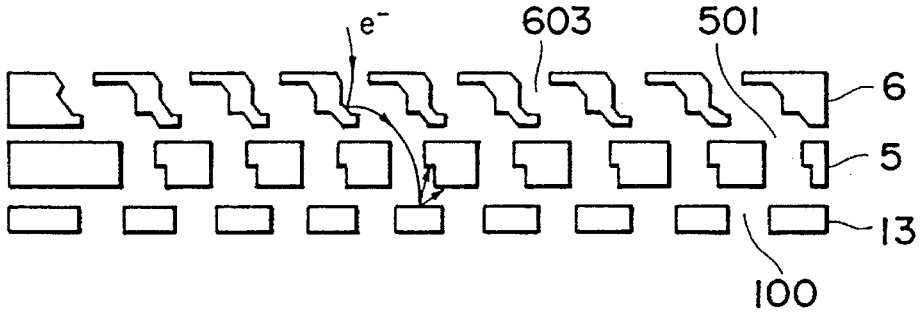
FIG. 15 is a sectional view showing part of the structure of an electron multiplier in the photomultiplier according to the present invention.

FIG. 15 is a sectional view showing the main part of the structure of a typical embodiment of an electron multiplier in the photomultiplier shown in FIG. 14. This electron multiplier has the dynode unit 60 constituted by stacking N stages, e.g., seven stages of dynode plates 6 formed into a square flat plate. N represents an arbitrary natural number. A plurality of electron multiplication holes serving as dynodes are formed in each dynode plate 6 by etching or the like to extend through the plate having a conductive surface in the direction of thickness and arranged in a matrix form at a predetermined pitch. An input opening is formed on the upper surface of the plate as one end of the electron multiplication hole serving as a dynode. An output opening is formed in the lower surface of the plate as the other end of the electron multiplication hole serving as a dynode. The diameter of each electron multiplication hole increases from the input opening to the output opening, and the inner wall of the inclined portion is formed into a curved surface. On the inner wall of the inclined portion which the electrons incident from the input opening bombard, Sb is deposited and reacted with an alkali metal compound as of K or Cs to form a secondary electron emitting layer. The dynode plates 6 are set at potentials to form a damping field for guiding the secondary electrons emitted from the upper-stage dynode plates 6 to the lower-stage dynode plates 6. For example, the potential is increased by every 100 V from the upper stage to the lower stage.

The dynode plate 6 shown in FIG. 15 is the last-stage dynode plate of the dynode unit 60. An anode plate 5 and an inverting dynode plate 13 are sequentially disposed under the last-stage dynode plate 6. A plurality of electron passage holes 501 are formed in the anode plate 5 by etching or the like to extend through the plate in the direction of thickness. Each electron passage hole 501 is formed at a position where the secondary electrons emitted from the electron multiplication hole (dynode 603) of the last-stage dynode plate 6 reach. An input opening serving as one end of the electron passage hole 501 is formed on the upper surface (dynode plate 6 side) of this plate, and an output opening serving as the other end of the electron passage hole 501 is formed on the lower surface (inverting dynode plate 13 side). The diameter of the electron passage hole 501 increases from the input opening side to the output opening. More specifically, in the electron passage hole 501, the lower surface side of the anode plate 5 is partially notched such that the electrons obliquely incident on the anode plate 5 efficiently pass through the hole without bombarding the inner wall, thereby extending the capture area of the secondary electrons orbit-inverted by the inverting dynode plate 13. The potential of the anode plate 5 is set higher than that of any dynode plate 6, and for example, held at 1,000 V. Therefore, the secondary electrons orbit-inverted by the inverting dynode plate 13 toward the anode plate 5 are captured by the anodes of the anode plate 5.

A plurality of through holes 100 are formed in the inverting dynode plate 13 by etching or the like to extend through the plate in the direction of thickness. The through holes 100 are arranged in a matrix form at a pitch almost equal to that of the electron multiplication holes 603 of the last-stage dynode plate 6. Each through hole 100 is formed between a plurality of positions where the secondary electrons passing through the electron passage holes 501 of the anode plate 5 reach. This position changes depending on the distance between the anode plate 5 and the inverting dynode plate 13. An input opening serving as one end of the through hole 100 is formed in the upper surface (anode plate 5 side) of the inverting dynode plate 13, and an output opening serving as the other end of the through hole 100 is formed in the lower surface (metal base 4 side). The openings have almost the same diameter. The potential of the inverting dynode plate 13 is set lower than that of the anode plate 5, and for example, held at 900 V. Therefore, the orbits of the secondary electrons passing through the electron passage holes 501 of the anode plate 5 are inverted by the inverting dynode plate 13 toward the anode plate 5.

The metal base 4 constituting the base member and the photocathode 3 are rendered conductive through the metal housing 1. The metal base 4 serving as a shield electrode is set to almost the same potential as in the photocathode 3, and for example, the potential is held at 0 V. For this reason, the metal base 4 serves as an electrode for inverting, toward the anode plate 5, the orbits of the secondary electrons passing through the through holes 100 of the inverting dynode plate 13.

According to the above structure, the plurality of through holes 100 are formed in the inverting dynode plate 13 and arranged in a matrix form at a pitch almost equal to that of the electron multiplication holes 603 of the last-stage dynode plate 6. For this reason, the alkali metal vapor introduced into the vacuum container from the bottom portion (metal base 4) of the vacuum container through the metal tip tube 16 passes through the through holes 100 of the inverting dynode plate 13, the electron passage holes 501 of the anode plate 5, the electron multiplication holes 603 of each dynode plate 6 of the dynode unit 60, and the through holes (focusing electrodes 8) of the focusing electrode plate 7. The photocathode 3 on the light receiving plate 2 and the secondary electron emitting layers on the dynodes 603 are deposited to an almost uniform thickness from the central portion to the peripheral portion of each plate and activated. As a result, in the light receiving plate 2, the photoelectrons are generated according to the incident light at almost uniform reactivity with respect to the positions of the photocathode 3. In each dynode plate 6, the secondary electrons are emitted according to the incident photoelectrons at almost uniform reactivity with respect to the positions of the secondary electron emitting layers. Therefore, the output signals obtained by capturing the secondary electrons can be obtained at an almost uniform sensitivity in correspondence with the position of the photocathode 3 for receiving the incident light.

In addition, the plurality of electron passage holes 501 are formed in the anode plate 5 and arranged in a matrix form at positions where the secondary electrons emitted from the last-stage dynode plate 6 reach. The plurality of through holes 100 are formed in the inverting dynode plate 13 and arranged in a matrix form between a plurality of positions where the secondary electrons emitted from the anode plate 5 reach. For this reason, the secondary electrons emitted from the last-stage dynode plate 6 efficiently pass through the electron passage holes 501 of the anode plate 5 and are orbit-inverted by the inverting dynode plate 13 toward the anodes of the anode plate 5. Each anode of the anode plate 5 has a larger area exposed to the inverting dynode plate 13 than that exposed to the last-stage dynode plate 6. In other words, the diameter of the output opening of the electron passage hole 501, which opposes the inverting dynode plate 13, is formed larger than that of the input opening. Therefore, field strength in the anodes of the anode plate 5 increases to decrease the space charge in the electron passage holes 501. Since the area of each anode exposed to the inverting dynode plate 13 side is increased, the secondary electrons to be captured by the anodes increase. More specifically, since the secondary electrons emitted from both the last-stage dynode plate 6 and the inverting dynode plate 13 are efficiently captured by the anodes of the anode plate 5, output pulses proportional to the energy of the incident light can be obtained.

The metal base 4 serving as a shield electrode is set to the same potential as in the photocathode 3 to invert the orbits of the secondary electrons incident on the through holes 100 of the inverting dynode plate 13 toward the anode plate 5. For this reason, the secondary electrons passing through the electron passage holes 501 of the anode plate 5 hardly pass through the through holes 100 of the inverting dynode plate 13 and are efficiently captured by the anodes of the anode plate 5.

In summary, generation of the photoelectrons or emission of the secondary electrons is performed in the photocathode 3 or the dynodes of each dynode plate 6 at uniform reactivity. Therefore, variations in sensitivity of the output signals in correspondence with the positions of the photocathode 3 on which the light is incident are reduced.

Figure 16:
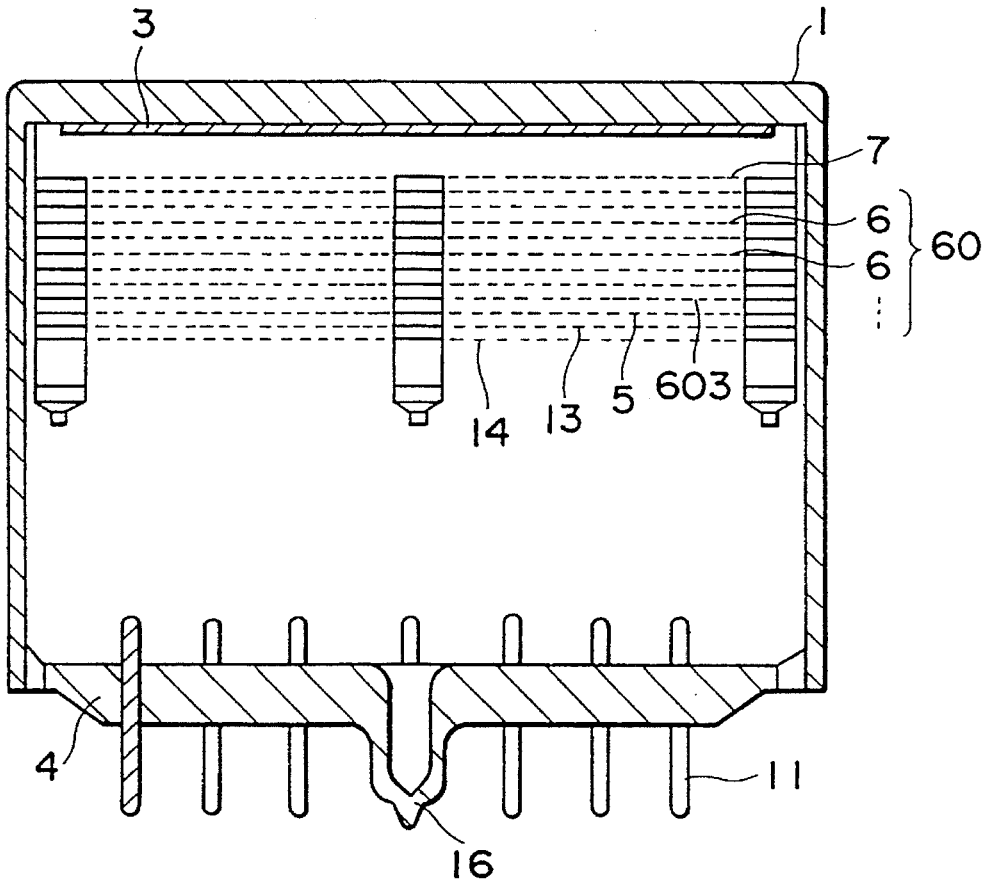
FIG. 16 is a sectional view showing the structure of the second application of the photomultiplier according to the present invention.

FIG. 16 is a sectional view showing the structure of a photomultiplier according to the second embodiment of the present invention. In this photomultiplier, a photocathode 3, formed on the inner surface of a light receiving plate for receiving incident light, for emitting photoelectrons, a focusing electrode plate 7 for focusing the photoelectrons, and an electron multiplier for receiving and multiplying the photoelectrons are disposed in a bottomed cylindrical vacuum container (housing 1) consisting of borosilicate glass having an outer diameter of 3 inches.

Connecting pins 11 connected to external voltage terminals to apply a desired voltage to dynode plates 6 or the like extend through a base member 4 of the vacuum container. A metal tip tube 16 having the end portion compression-bonded and sealed projects downward (outside the vacuum container) from the center of the base member 4. This metal tip tube 16 is used to introduce an alkali metal vapor into the vacuum container or evacuate the vacuum container. After the metal tip tube 16 is used, its end portion is sealed, as shown in FIG. 16.

On the inner lower surface of the light receiving plate 2, after MnO or Cr is vacuum-deposited, Sb is deposited, and an alkali metal such as K or Cs is then formed and activated to form the bialkali photocathode 3. This photocathode 3 is set at a desired potential, and for example, the potential is held at 0 V.

The focusing electrode plate 7 formed of a stainless plate is disposed between the photocathode 3 and the dynode unit 60. A plurality of through holes are formed in this focusing electrode 7 and arranged in a matrix form at a predetermined pitch. These through holes serve as focusing electrodes 8. The focusing electrodes 8 are set at a desired potential, and for example, the potential is held at 100 V. Therefore, the photoelectrons emitted from the photocathode 3 are focused by the focusing electrodes 8 and incident on a predetermined region (first-stage dynode plate 6) of the dynode unit 60.

Figure 17:
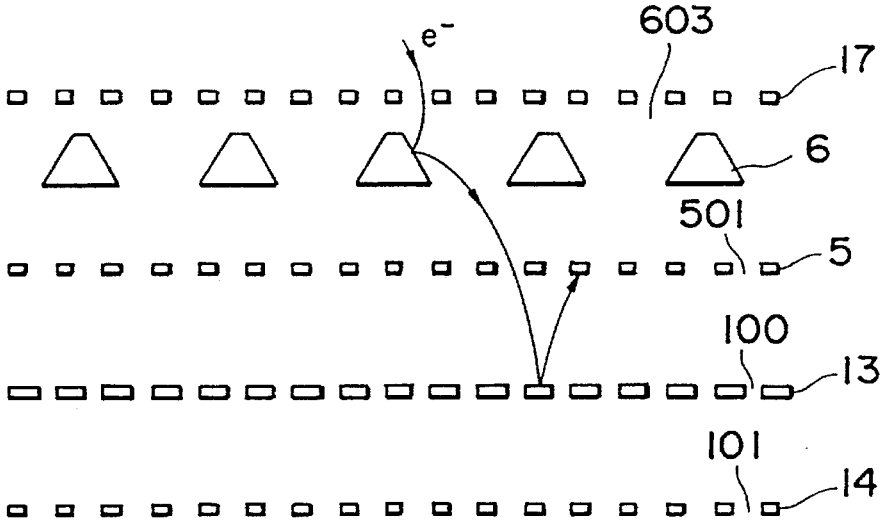
FIG. 17 is a sectional view showing the main part of the structure of the first application of the electron multiplier in the photomultiplier shown in FIG. 16.

FIG. 17 is a sectional view showing the main part of the structure of the first application of the electron multiplier in the photomultiplier shown in FIG. 16. This electron multiplier includes the dynode unit 60 constituted by stacking N stages of dynode plates 6. The dynode plates 6 substantially extend in an area almost corresponding to the inner diameter of the vacuum container on planes perpendicular to the tube axis and are fixed by insulating spacers 8 (see FIG. 21) at the peripheral portions at predetermined intervals. A plurality of electron multiplication holes (portions serving as dynodes) are formed in each dynode plate 6 by etching or the like to extend through the plate having a conductive surface in the direction of thickness. These electron multiplication holes are arranged in a matrix form at a pitch of 0.72 mm. Each electron multiplication hole has a rectangular tubular shape, and the size of the input port is larger than that of the output port. On the inner walls of the two equal inclined portions where the electrons incident from the input port are bombarded, Sb is deposited and reacted with an alkali metal compound as of K or Cs to form secondary electron emitting layers. FIG. 17 shows only the last-stage dynode plate 6 of the dynode unit 60.

Electric field forming electrodes 17 are disposed between the dynode plates 6 to form a damping field for guiding the secondary electrons emitted from the dynodes of preceding dynode plate 6 to the dynodes of the subsequent dynode plate 6. The electric field forming electrodes 17 comprise regular hexagonal electron passage holes densely formed in a stainless thin plate in a mesh.

An anode plate 5, an inverting dynode plate 13, and a shield electrode plate 14 are sequentially disposed under the last-stage dynode plate 6 (base member 4 side). The anode plate 5 is constituted by a stainless thin plate, as in the field forming electrodes 17. The anode plate 5 has electrode passage holes arranged in a mesh through which the secondary electrons emitted from dynodes 603 of the last-stage dynode plate 6 pass. The potential of the anode plate 5 is set higher than that of any dynode plate 6 and, for example, held at 1,000 V. Since the anode plate 5 is also set at a potential higher than that of the inverting dynode plate 13, the secondary electrons passing through the anode plate 5 are orbit-inverted by the inverting dynode plate 13 toward the anode plate 5 and captured by the anodes.

The inverting dynode plate 13 is constituted by a stainless thin plate as in the electric field forming electrodes 17. The inverting dynode plate 13 has through holes 100 arranged in a mesh, and the ratio of an opening area to the plate area is about 10%. The potential of the inverting dynode plate 13 is set lower than that of the anode plate 5 and, for example, held at 900 V. Therefore, the secondary electrons passing through the electron passage holes 501 of the anode plate 5 are orbit-inverted by the inverting dynode plate 13 toward the anode plate 5.

The shield electrode plate 14 is constituted by a stainless thin plate as in the field forming electrodes 17. The shield electrode plate 14 has through holes 101 arranged in a mesh. The potential of the shield electrode plate 14 is set lower than that of the inverting dynode plate 13 and, for example, held at 0 V. For this reason, the secondary electrons incident on the through holes 100 of the inverting dynode plate 13 are orbit-inverted toward the anode plate 5.

According to the above structure, the plurality of through holes 100 are arranged in the inverting dynode plate 13. For this reason, the alkali metal vapor introduced into the vacuum container from the bottom portion of the vacuum container (base member 4 side) through the metal tip tube 16 passes through the through holes 101 of the shield electrode plate 14, the through holes 100 of the inverting dynode plate 13, the electron passage holes 501 of the anode plate 5, the electron multiplication holes (portions serving as dynodes) of each dynode plate 6 of the dynode unit 60, and the through holes (focusing electrodes 8) of the focusing electrode plate 7. The photocathode 3 on the light receiving plate and the secondary electron emitting layers on the electron multiplication holes of each dynode plate 6 are deposited to an almost uniform thickness from the central portion to the peripheral portion of each plate and activated. As a result, in the light receiving plate, the secondary electrons are emitted upon incidence of light at almost uniform reactivity with respect to the positions of the photocathode 3. In each dynode plate 6, the secondary electrons are emitted upon incidence of the electrons at almost uniform reactivity with respect to the positions of the dynodes 603. Therefore, the output signals obtained by capturing the secondary electrons are obtained at almost uniform sensitivity in correspondence with the position of the photocathode 3 for receiving the incident light.

The shield electrode plate 14 is set to a potential lower than that of the inverting dynode plate 13. For this reason, the secondary electrons incident on the through holes 100 of the inverting dynode plate 13 are inverted toward the anode plate 5. Therefore, the secondary electrons passing through the electron passage holes 501 of the anode plate 5 hardly pass through the inverting dynode plate 13 and are efficiently captured by the anodes of the anode plate 5.

In summary, generation of the photoelectrons or emission of the secondary electrons is performed in the photocathode 3 or the dynodes 603 of each dynode plate 6 at uniform reactivity. Therefore, variations in sensitivity of the output signals in correspondence with the positions of the photocathode 3 on which the light is incident are reduced.

Figure 18:
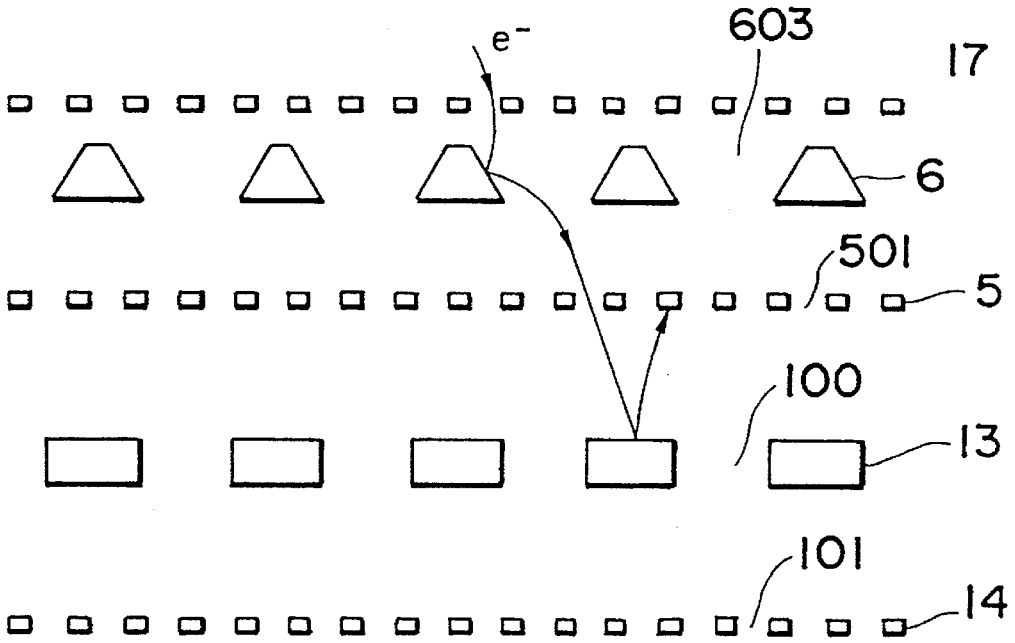
FIG. 18 a sectional view showing the main part of the structure of the second application of the electron multiplier in the photomultiplier shown in FIG. 16.

FIG. 18 is a sectional view showing the main part of the structure of the second application of the electron multiplier in the photomultiplier shown in FIG. 16. This electron multiplier has almost the same structure as in the electron multiplier shown in FIG. 17. However, the through holes 100 formed in the inverting dynode plate 13 are arranged in a matrix form at a pitch almost equal to that of the electron multiplication holes (dynodes 603) of the last-stage dynode plate 6. The ratio of an opening area to the plate area is about 50%. Each through hole 100 is formed between a plurality of positions where the secondary electrons emitted from the electron passage holes 501 of the anode plate 5 reach. This position changes depending on the distance between the anode plate 5 and the inverting dynode plate 13, and for example, the through holes 100 are formed immediately under the dynodes 603 of the last-stage dynode plate 6. An input opening serving as one end of the through hole 100 is formed in the upper surface (anode plate 5 side) of the plate, and an output opening serving as the other end of the through hole 100 is formed in the lower surface (shield electrode plate 14 side). The input and output openings have almost the same diameter. The diameter of the through hole 100 is almost the same as that of the electron multiplication hole 603 of each dynode plate 6. The potential of the inverting dynode plate 13 is set lower than that of the anode plate 5 and, for example, held at 900 V. Therefore, the secondary electrons passing through the electron passage holes 501 of the anode plate 5 are orbit-inverted by the inverting dynode plate 13 toward the anode plate 5.

According to the above structure, almost the same function as in the electron multiplier shown in FIG. 17 can be obtained. The through holes 100 of the inverting dynode plate 13 are arranged at a pitch almost equal to that of the electron multiplication holes 603 of each dynode plate 6. For this reason, the alkali metal vapor introduced into the vacuum container from the bottom portion (base member 4 side) of the vacuum container through the metal tip tube 16 efficiently passes through the through holes 101 of the shield electrode plate 14, the through holes 100 of the inverting dynode plate 13, the electron passage holes 501 of the anode plate 5, the electron multiplication holes 603 of each dynode plate 6 of the dynode unit 60, and the through holes (focusing electrodes 8) of the focusing electrode plate 7. The photocathode 3 on the light receiving plate and the secondary electron emitting layers on each dynode plate 6 are deposited to an almost uniform thickness from the central portion to the peripheral portion of each plate and activated. As a result, in the light receiving plate, the photoelectrons are generated upon incidence of light at almost uniform reactivity with respect to the positions of the photocathode 3. In each dynode plate 6, the secondary electrons are emitted upon incidence of electrons at almost uniform reactivity with respect to the positions of the dynodes 603. Therefore, output signals obtained by capturing the secondary electrons are obtained at almost uniform sensitivity with respect to the positions on the photocathode 3 for receiving the incident light.

Each through hole 100 of the inverting dynode plate 13 is formed between a plurality of positions where the secondary electrons passing through the electron passage holes 501 of the anode plate 5 reach. For this reason, the secondary electrons passing through the electron passage holes 501 of the anode plate 5 hardly pass through the through holes 100 of the inverting dynode plate 13.

In summary, generation of the photoelectrons or emission of the secondary electrons is performed in the photocathode 3 or the dynodes 603 of each dynode plate 6 at uniform reactivity. Therefore, variations in sensitivity of the output signals in correspondence with the positions of the photocathode on which the light is incident are further reduced.

Figure 19:
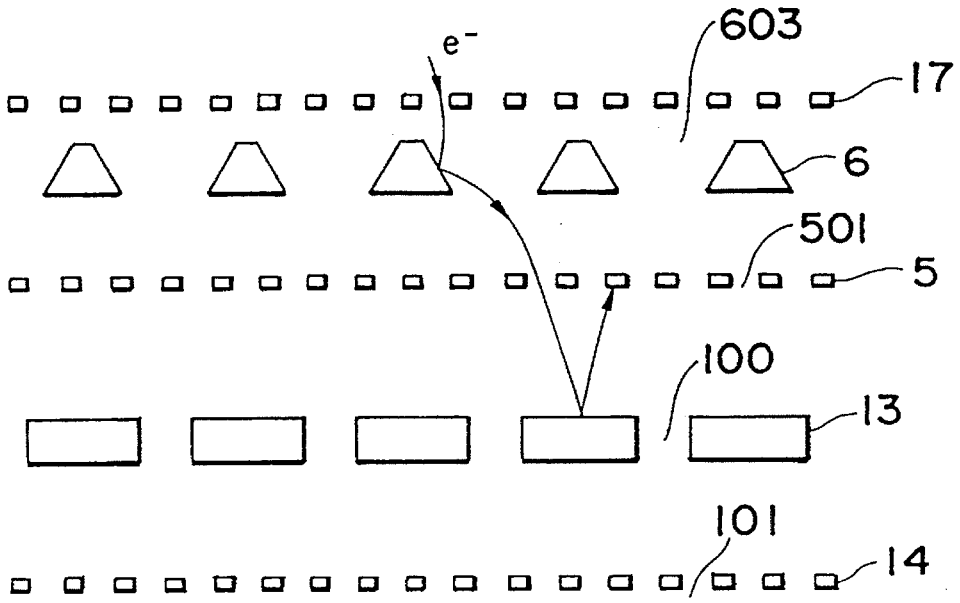
FIG. 19 is a sectional view showing the main part of the structure of the third application of the electron multiplier in the photomultiplier shown in FIG. 16, and especially the structure of the peripheral portion.
Figure 20:
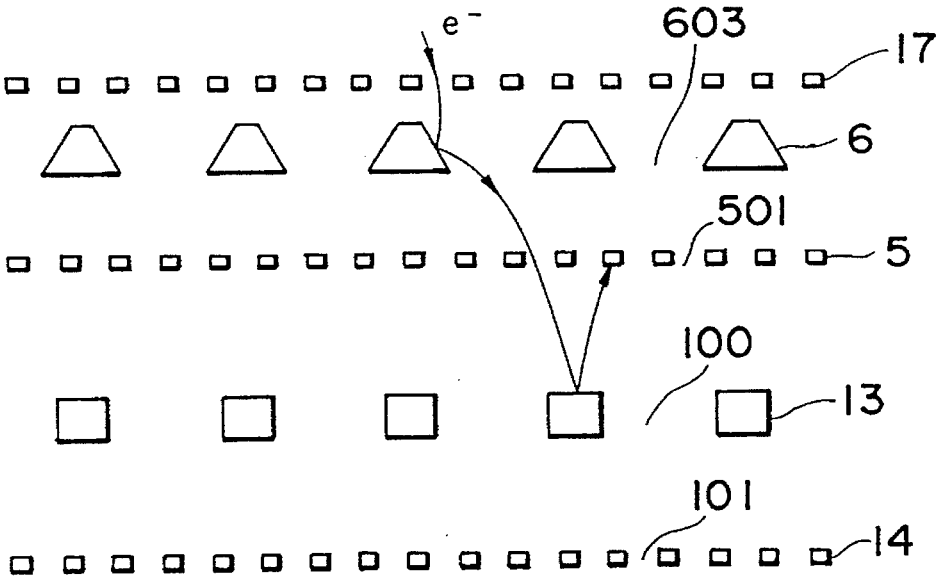
FIG. 20 is a sectional view showing the main part of the structure of the third application of the electron multiplier in the photomultiplier shown in FIG. 16, and especially the structure of the central portion.

FIGS. 19 and 20 show the structure of the third application of the electron multiplier in the photomultiplier shown in FIG. 16. FIG. 19 is a sectional view showing the main part of the peripheral portion of the electron multiplier, and FIG. 20 is a sectional view showing the main part of the central portion of the electron multiplier. This electron multiplier has almost the same structure as the electron multiplier shown in FIG. 17. However, each through hole 100 of the inverting dynode plate 13 is formed between a plurality of positions where the secondary electrons passing through the electron passage holes 501 of the anode plate 5 reach. This position changes depending on the distance between the anode plate 5 and the inverting dynode plate 13. For example, the through holes 100 are formed immediately under the electron multiplication holes 603 of the last-stage dynode plate 6. An input opening serving as one end of the through hole 100 is formed in the upper surface (anode plate 5 side) of the plate, and an output opening serving as the other end of the through hole 100 is formed in the lower surface (shield electrode plate 14 side). The through holes have a diameter small at the peripheral portion of the plate and large at the central portion of the plate. The potential of the inverting dynode plate 13 is set lower than that of the anode plate 5 and, for example, held at 900 V. Therefore, the secondary electrons passing through the electron passage holes 501 of the anode plate 5 are orbit-inverted by the inverting dynode plate 13 toward the anode plate 5.

According to the above structure, almost the same function as in the electron multiplier shown in FIG. 17 can be obtained. The through holes 100 of the inverting dynode plate 13 have a diameter small at the peripheral portion of the plate and large at the central portion. For this reason, the alkali metal vapor introduced into the vacuum container from the bottom portion (base member 4 side) of the vacuum container through the metal tip tube 16 efficiently passes through the through holes 101 of the shield electrode plate 14, the through holes 100 of the inverting dynode plate 13, the electron passage holes 501 of the anode plate 5, the electron multiplication holes 603 of each dynode plate 6 of the dynode unit 60, and the through holes (focusing electrodes 8) of the focusing electrode plate 7. The photocathode 3 on the light receiving plate and the secondary electron emitting layers on each dynode plate 6 are deposited to an almost uniform thickness from the central portion to the peripheral portion of each plate and activated. As a result, in the light receiving plate, the photoelectrons are generated according to the incident light at almost uniform reactivity with respect to the positions on the photocathode 3. In each dynode plate 6, the secondary electrons are emitted according to the incident electrons at almost uniform reactivity with respect to the positions of the dynodes 603. Therefore, output signals obtained by capturing the secondary electrons are obtained at almost uniform sensitivity with respect to the positions on the photocathode 3 for receiving the incident light.

In summary, generation of the photoelectrons or emission of the secondary electrons is performed in the photocathode 3 and the dynodes 603 of each dynode plate 6 at uniform reactivity. Therefore, variations in sensitivity of the output signals in correspondence with the positions on the photocathode 3 on which the light is incident are further reduced.

FIG. 21 is a sectional view showing the main part of the structure of the fourth application of the electron multiplier in the photomultiplier shown in FIG. 16. This electron multiplier includes the dynode unit 60. The dynode unit 60 is constituted by stacking N stages of dynode plates 6. The dynode plates 6 extend in an area corresponding to the inner diameter of the vacuum container on planes perpendicular to the tube axis and are fixed by the insulating spacers 8 (the insulating members 8*a* and 8*b*) at the peripheral portions at predetermined intervals. A plurality of electron multiplication holes (serving as dynodes) are formed in each dynode plate 6 by etching or the like to extend through the plate having a conductive surface in the direction of thickness. The dynodes 603 are arranged in the dynode plate 6 in a matrix form at a predetermined pitch. A circular input opening serving as one end of the electron multiplication hole is formed in the upper surface (photocathode 3 side) of the dynode plate 6, and a circular output opening serving as the other end of the electron multiplication hole is formed in the lower surface (anode plate 5 side). The diameter of the output opening of the electron multiplication hole is larger than that of the input opening. The electron multiplication hole has a tapered shape extending toward the output opening. On the inner walls of the two equal inclined portions which the electrons incident from the input opening are bombarded, Sb is deposited and reacted with an alkali metal compound as of K or Cs to form secondary electron emitting layers.

The anode plate 5, the inverting dynode plate 13, and the shield electrode plate 14 are sequentially disposed under the last-stage dynode plate 6 (base member 4 side). The regular hexagonal electron passage holes 501 having a side length of 0.42 mm and densely formed in the stainless thin plate are formed in the anode plate 5 by etching or the like. The electron passage holes 501 are arranged in the anode plate 5 in a mesh through which the secondary electrons emitted from the last-stage dynode plate 6 pass. The potential of the anode plate 5 is set higher than that of any dynode plate 6 and, for example, held at 1,000 V. Since the potential of the anode plate 5 is also set higher than that of the inverting dynode plate 13, the secondary electrons passing through the anode plate 5 are inverted by the inverting dynode plate 13 toward the anode plate 5 side and captured by the anodes.

A plurality of through holes 100 are formed in the inverting dynode plate 13 by etching or the like to extend through the plate in the direction of thickness and arranged in a matrix form at a pitch almost equal to that of the electron multiplication holes as a dynode 603 of the last-stage dynode plate 6. The ratio of the area of the through holes 100 to the area of the plate is about 50%. Each through hole 100 is formed between a plurality of positions where the secondary electrons passing through the electron passage holes 501 of the anode plate 5 reach. This position changes depending on the distance between the anode plate 5 and the inverting dynode plate 13. An input opening serving as one end of the through hole 100 is formed in the upper surface (anode plate 5 side) of the plate, and an output opening serving as the other end of the through hole 100 is formed in the lower surface (shield electrode plate 14 side). The openings have almost the same diameter. The potential of the inverting dynode plate 13 is set lower than that of the anode plate 5 and, for example, held at 900 V. Therefore, the secondary electrons passing through the electron passage holes 501 of the anode plate 5 are orbit-inverted by the inverting dynode plate 13 toward the anode plate 5.

The shield electrode plate 14 has through holes 101 arranged in a mesh as in the anode plate 5. The potential of the shield electrode plate 14 is set lower than that of the inverting dynode plate 13 and, for example, held at 0 V. For this reason, the secondary electrons incident on the through holes 100 of the inverting dynode plate 13 are orbit-inverted toward the anode plate 5.

According to the above structure, almost the same function as in the electron multiplier shown in FIG. 17 can be obtained.

Figure 1:
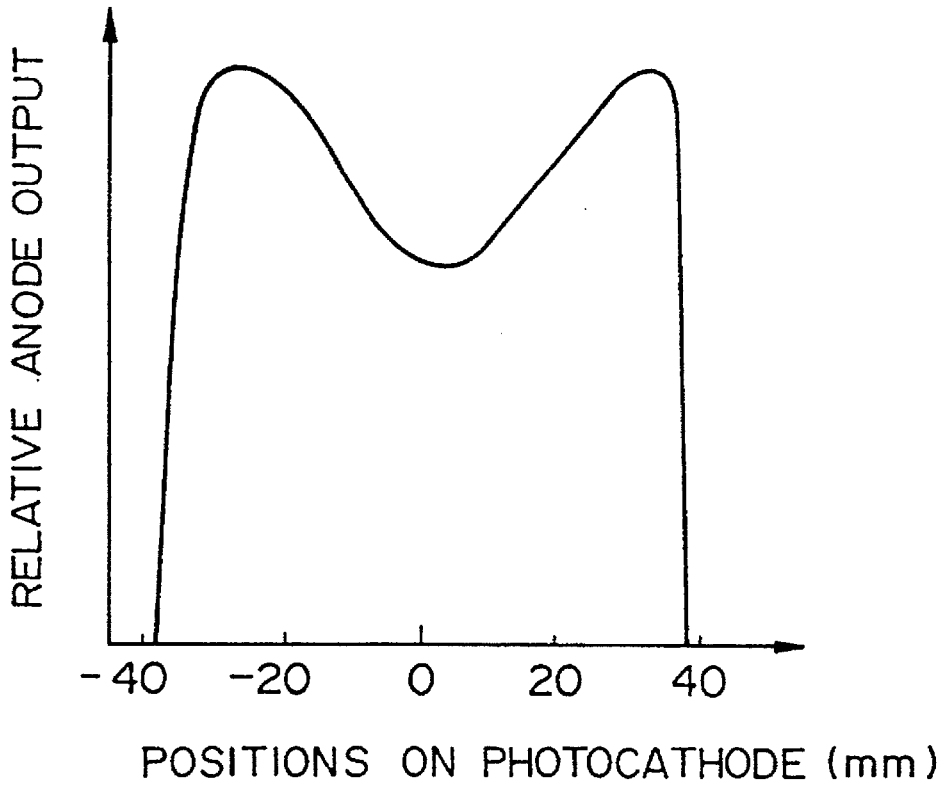
Fig. 1 (PRIOR ART)
FIG. 1 is a graph showing the relationship between positions on a photocathode and an anode output in a conventional photomultiplier.
Figure 22:
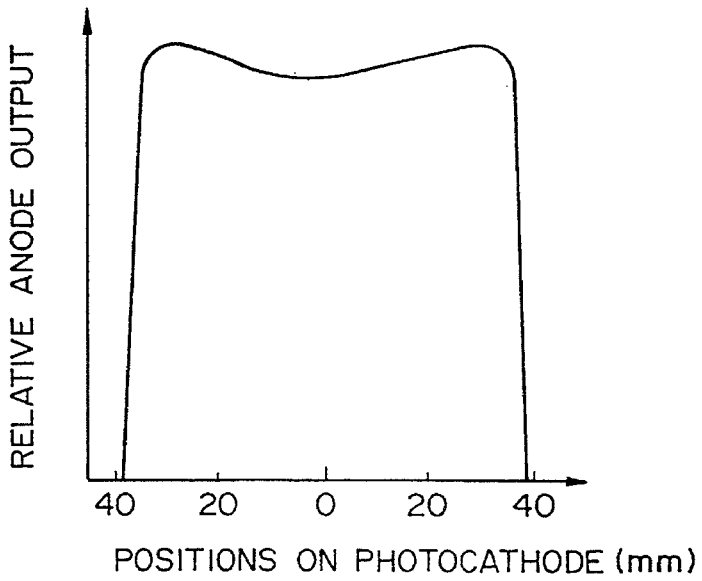
FIG. 22 is a graph showing the relationship between positions on the photocathode of the electron multiplier shown in FIG. 18 and the anode output in the photomultiplier shown in FIG. 16.
Figure 23:
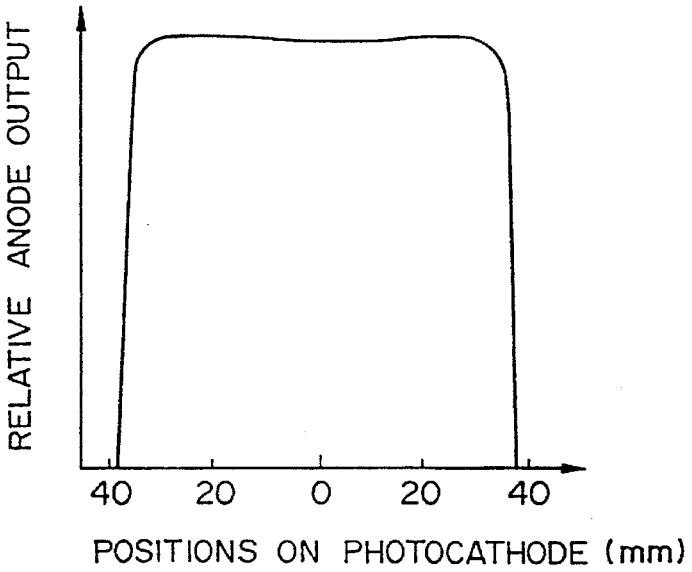
FIG. 23 is a graph showing the relationship between positions on the photocathode of the electron multiplier shown in FIG. 19 and 20 and the anode output in the photomultiplier shown in FIG. 16.

FIGS. 22 and 23 show the relationship between positions on the photocathode and the anode output in the photomultiplier shown in FIG. 16. FIG. 22 is a graph in the second application of the electron multiplier shown in FIG. 18, and FIG. 23 is a graph in the third application of the electron multiplier shown in FIGS. 19 and 20. A position on the circular photocathode 3 is plotted along the abscissa, in which the origin represents the center of the photocathode 3, and a relative value of the output signal from each anode of the anode plate 5 with respect to the light incident on each position on the photocathode 3 is plotted along the ordinate. As a result, in the electron multiplier shown in FIG. 18, the output signals from the anodes of the anode plate 5 decrease by about 5% at the central portion as compared to the peripheral portion of the photocathode 3. Therefore, variations in sensitivity of the output signals in correspondence with the positions on the photocathode 3 at which the light is incident are greatly reduced as compared to the prior art (FIG. 1).

In the electron multiplier shown in FIGS. 19 and 20, the output signals from the anodes of the anode plate 5 are almost uniform from the peripheral portion to the central portion of the photocathode 3. Therefore, variations in sensitivity of the output signals in correspondence with the positions on the photocathode 3 at which the light is incident are substantially eliminated.

The present invention is not limited to the above embodiments, and various changes and modifications can be made.

For example, in the above embodiments, the diameter of the through holes is changed such that the opening ratio of through holes 100 of the inverting dynode plate 13 becomes low at the peripheral portion and high at the central portion (see FIG. 3). On the other hand, even when the pitch between the through holes is decreased at the peripheral portion and increased at the central portion, the same function and effect as described above can be obtained (see FIG. 4).

In the above embodiments, the hermetic glass 15 is formed into a tapered shape. When the working voltage is low, the hermetic glass 15 can have a flat surface, and the diameter of the glass can be increased.

The anodes used in each embodiment described above may be replaced with a multi-anode mounted in a rectangular mounting hole extending through the metal base 4. In this case, output signals are extracted from a large number of anode pins arranged in a matrix form and vertically extending on the multi-anode, thereby detecting positions.

In each embodiment described above, a plurality of connecting pins 11 vertically extend through the metal base 4 through the tapered hermetic glass 15 and are rectangularly arranged. On the other hand, when a large disk-like tapered hermetic glass may be mounted in a circular mounting hole extending through the metal base 4, and a plurality of connecting pins 11 may directly extend therethrough at its peripheral portion, thereby reducing the number of components and the cost.

As has been described above in detail, according to the present invention, a plurality of through holes are arranged in the inverting dynode plate. Therefore, when an alkali metal vapor is introduced into the vacuum container from the bottom portion of the vacuum container, the alkali metal vapor sequentially passes through the through holes of the inverting dynode plate, the electron passage holes of the anode plate, the electron multiplication holes (dynodes) of each dynode plate, and the through holes (focusing electrodes) of the focusing electrode plate and are almost uniformly deposited on the surfaces of the dynodes and the light receiving plate. Since the shield electrode plate inverts the secondary electrons incident on the through holes of the inverting dynode plate toward the anode plate, the secondary electrons are efficiently captured by the anodes of the anode plate. As a result, generation of the photoelectrons or emission of the secondary electrons is performed in the photocathode or the dynodes of each dynode plate at uniform reactivity.

Therefore, a photomultiplier can be provided in which an almost uniform sensitivity is obtained in the output signals in correspondence with the positions of the photocathode on which the light is incident.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An electron multiplier comprising:

an anode having a plurality of openings:

a dynode unit for cascade-multiplying incident electrons, constituted by stacking a plurality of stages of dynodes, spaced apart from each other at predetermined intervals; and an inverting dynode plate being arranged to oppose in parallel to said anode such that said anode is sandwiched between said dynode unit and said inverting dynode plate, and having a plurality of through holes for injecting a metal vapor to form at least a secondary electron emitting layer on a surface of an each-stage dynode of said dynode unit, each of said through holes being arranged at a region of said inverting dynode plate other than a region which the secondary electrons passing through said openings of said anode reach.

2. A electron multiplier according to claim 1, further comprising a shield electrode plate being arranged to oppose in parallel to said inverting dynode plate such that said inverting dynode plate is sandwiched between said anode and said shield electrode plate.

3. An electron multiplier comprising:

a dynode unit having a plurality of stages of dynode plates stacked in an incident direction of electrons, said dynode plates spaced apart from each other at predetermined intervals through insulating members, each said dynode plate supporting at least one dynode for cascade-multiplying the incident electrons;

an anode plate for supporting a plurality of anodes, said anode plate having electron through holes through which secondary electrons pass in correspondence with a position where the secondary electrons emitted from a last-stage dynode plate of said dynode unit reach and being arranged to oppose in parallel to said last-stage dynode plate through a first insulating member; and an inverting dynode plate for supporting at least one inverting dynode for inverting orbits of the secondary electrons passing through said anode plate toward said anode, said inverting dynode plate having a plurality of through holes for injecting a metal vapor to form at least a secondary electron emitting layer on a surface of an each-stage dynode of said dynode unit at positions opposing said anodes, and said inverting dynode plate being arranged to oppose in parallel to said anode plate through a second insulating member such that said anode plate is sandwiched between said last-stage dynode plate of said dynode unit and said inverting dynode plate, each of said through holes in said inverting dynode plate being arranged at a region of said inverting dynode plate other than a region which the secondary electrons passing through said electron through holes of said anode plate reach.

4. A multiplier according to claim 3, wherein, of said through holes formed in said inverting dynode plate to inject the metal vapor, a through hole positioned at a center of said inverting dynode plate has an area larger than that of a through hole positioned at a periphery of said inverting dynode plate.

5. A multiplier according to claim 3, wherein, of said through holes formed in said inverting dynode plate to inject the metal vapor, through holes positioned adjacent to each other at a center of said inverting dynode plate have an interval therebetween smaller than that between through holes positioned adjacent to each other at a periphery of said inverting dynode plate.

6. A multiplier according to claim 3, further comprising a shield electrode plate for supporting at least one shield electrode for inverting orbits of the secondary electrons passing through said anode plate toward said anode, said shield electrode having a plurality of through holes for injecting the metal vapor to form at least said secondary electron emitting layer on a surface of an each-stage dynode of said dynode unit and said shield electrode plate being arranged to oppose in parallel to said inverting dynode plate through a third insulating member such that said inverting dynode plate is sandwiched between said anode plate and said shield electrode plate.

7. A multiplier according to claim 6, wherein said shield electrode plate has a concave portion, formed in at least one main surface opposing said inverting dynode plate, for arranging said third insulating member partially in contact with said concave portion such that a gap is formed between a surface of said third insulating member and a main surface of said concave portion to prevent discharge between said inverting dynode plate and said shield electrode plate.

8. A multiplier according to claim 5, wherein said shield electrode plate has an engaging member engaged with a corresponding one of connecting pins for applying a desired voltage at a predetermined position of a side surface thereof, said side surface in parallel to the incident direction of said electrons.

9. A multiplier according to claim 7, wherein said engaging member is constituted by a pair of guide pieces for guiding said corresponding connecting pin.

10. A multiplier according to claim 3, wherein said anode plate has a first concave portion, formed in a first main surface opposing said last-stage dynode plate of said dynode unit, for arranging said first insulating member partially in contact with said first concave portion such that a gap is formed between a surface of said first insulating member and a main surface of said first concave portion to prevent discharge between said last-stage dynode plate and said anode plate, and a second concave portion, formed in a second main surface opposing said inverting dynode plate, for arranging said second insulating member partially in contact with said second concave portion, said second concave portion contacting to said first concave portion through a through hole, such that a gap is formed between a surface of said second insulating member and a main surface of said second concave portion to prevent discharge between said inverting dynode plate and said anode plate, said first and second insulating members being in contact with each other in said through hole.

11. A multiplier according to claim 3, wherein said anode plate has an engaging member engaged with a corresponding one of connecting pins for applying a desired voltage at a predetermined position of a side surface thereof, said side surface in parallel to the incident direction of said electrons.

12. A multiplier according to claim 9, wherein said engaging member is constituted by a pair of guide pieces for guiding the corresponding connecting pin.

13. A multiplier according to claim 3, wherein said inverting dynode plate has a first concave portion, formed in at least a first main surface opposing said anode plate, for arranging said second insulating member partially in contact with said first concave portion such that a gap is formed between a surface of said second insulating member and a main surface of said first concave portion to prevent discharge between said anode plate and said inverting dynode plate.

14. A multiplier according to claim 3, wherein said inverting dynode plate has an engaging member engaged with a corresponding one of connecting pins for applying a desired voltage at a predetermined position of a side surface thereof, said side surface in parallel to the incident direction of said electrons.

15. A multiplier according to claim 12, wherein said engaging member is constituted by a pair of guide pieces or guiding said corresponding connecting pin.

* * * * *